US008983311B2

(12) United States Patent
Nemoto et al.

(10) Patent No.: US 8,983,311 B2
(45) Date of Patent: Mar. 17, 2015

(54) IMAGE FORMING SYSTEM WITH AN IMAGE INSPECTION DEVICE

(71) Applicants: Masakazu Nemoto, Ibaraki (JP); Kenichi Kamoshida, Ibaraki (JP); Kazutoshi Obara, Ibaraki (JP); Noritaka Masuda, Ibaraki (JP)

(72) Inventors: Masakazu Nemoto, Ibaraki (JP); Kenichi Kamoshida, Ibaraki (JP); Kazutoshi Obara, Ibaraki (JP); Noritaka Masuda, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 168 days.

(21) Appl. No.: 13/718,432

(22) Filed: Dec. 18, 2012

(65) Prior Publication Data

US 2013/0164000 A1 Jun. 27, 2013

(30) Foreign Application Priority Data

Dec. 21, 2011 (JP) ..... 2011-279926
Mar. 15, 2012 (JP) ..... 2012-059339
Jul. 18, 2012 (JP) ..... 2012-159967

(51) Int. Cl.
*B65H 29/62* (2006.01)
*G03G 15/00* (2006.01)

(52) U.S. Cl.
CPC ..... *G03G 15/553* (2013.01); *G03G 15/5062* (2013.01); *G03G 15/6538* (2013.01)
USPC ..... 399/16; 399/18; 399/407; 382/112

(58) Field of Classification Search
CPC ..... B65H 29/62; G03G 15/6538; G03G 15/5062; H04N 1/00029; H04N 1/00092
USPC ..... 399/16, 18, 407; 271/279; 382/112
See application file for complete search history.

(56) References Cited

U.S. PATENT DOCUMENTS

| | | | | |
|---|---|---|---|---|
| 7,341,247 | B2 * | 3/2008 | Hirata et al. | 270/58.07 |
| 2003/0235328 | A1 * | 12/2003 | Nakamura et al. | 382/112 |
| 2008/0260395 | A1 * | 10/2008 | Honma | 399/15 |
| 2009/0245589 | A1 | 10/2009 | Komoto | |

FOREIGN PATENT DOCUMENTS

| | | |
|---|---|---|
| JP | 2004-338308 | 12/2004 |
| JP | 2009-230046 | 10/2009 |
| JP | 2010-041430 | 2/2010 |

* cited by examiner

*Primary Examiner* — Blake A Tankersley
(74) *Attorney, Agent, or Firm* — Harness, Dickey & Pierce, P.L.C.

(57) ABSTRACT

An image forming system includes an image forming unit configured to output image data onto a recording medium; a first conveying unit configured to convey the medium; a reading unit configured to read an image from the medium; a defect determining unit configured to determine whether the read image has a defect; a device connection determining unit configured to determine whether a discharge device is directly connected to an image inspection device at the downstream side or is connected to the image inspection device via another device at the downstream side; a second conveying unit configured to convey the medium to the discharge device on a longer conveying path, when the discharge device is directly connected to the image inspection device; a defective discharge tray to which the medium having a defective image is discharged; and a normal discharge tray to which the medium having a non-defective image is discharged.

10 Claims, 19 Drawing Sheets

IMAGE FORMING SYSTEM WITH AN IMAGE INSPECTION DEVICE

CROSS-REFERENCE TO RELATED APPLICATIONS

The present application claims priority to and incorporates by reference the entire contents of Japanese Patent Application No. 2011-279926 filed in Japan on Dec. 21, 2011, Japanese Patent Application No. 2012-059339 filed in Japan on Mar. 15, 2012 and Japanese Patent Application No. 2012-159967 filed in Japan on Jul. 18, 2012.

BACKGROUND OF THE INVENTION

1. Field of the Invention

The present invention relates to an image forming system.

2. Description of the Related Art

In the production-oriented printer market, printed materials themselves serve as the products. Hence, emphasis is on the productivity capability of image forming apparatuses that generate printed materials. Moreover, the image forming apparatuses are increasingly having an enhanced productivity so as to generate printed materials at high speed. Furthermore, since printed materials generated by the image forming apparatuses themselves serve as the products; maintaining the quality of the printed materials is also an important factor.

As a measure for maintaining the quality of printed materials, an image inspection device has been developed that inspects whether or not defects such as abnormal images are present in a printed material generated by an image forming apparatus. The image inspection device reads images from the printed material that is generated by an image forming apparatus, compares the image data that is obtained by reading images with the original image data that was used in generating the printed material, and determines whether or not there are any defects in the images formed on the printed material (i.e., performs a defect determination process).

As described above, when printed materials themselves serve as the products, it becomes necessary to ensure that any defective printed material, which has a defective image printed thereon, does not get mixed with normal printed materials having a non-defective image printed thereon. Therein, in the image inspection device, a typically-known technology is implemented to make sure that a defective printed material is discharged to a different discharge destination than the discharge destination for discharging normal printed materials.

There, in an image inspection device that is connected to a device which includes a separate discharge destination for defective printed materials, the defect determination process for determining whether or not there are any defects in the images formed on a printed material needs to be completed before that printed material reaches the device which includes a separate discharge destination for defective printed materials. However, depending on the image data or depending on the inspection details, it takes time to perform the defect determination process. Thus, there are times when the defect determination process does not get completed before a printed material reaches the device which includes a separate discharge destination for defective printed materials. The measures to tackle this issue are being studied.

As a proposed measure to tackle the case in which the defect determination process does not get completed before a printed material reaches the device which includes a separate discharge destination for defective printed materials, a technology has been proposed with the aim of securing sufficient time to ensure completion of the defect determination process. According to that technology, after the images formed on a printed material have been read, the printed material is conveyed forward at a lower conveying speed.

For example, an image forming apparatus has been disclosed that includes an image inspection device having a unit for determining whether or not there are defects in the images formed on a printed material, a discharge destination switching unit for switching between a discharge destination for defective printed materials and a discharge destination for normal printed materials, and a conveying speed control unit being capable of controlling the conveying speed of the printed material. In the image forming apparatus, during a period starting from the reading of the images formed on the printed material until the determination of defects in images is completed, the printed material is conveyed at a lower conveying speed than the specified conveying speed. Hence, it is ensured that a defective printed material is discharged to the discharge destination for defective printed materials, and the productivity is prevented from declining (see Japanese Patent Application Laid-open No. 2010-041430).

Apart from that, for example, an image inspection device has been disclosed that includes a reading unit that reads images; a discharge destination switching unit that switches the discharge destination for printed materials; a printed material storing unit that temporarily stores a printed material and that is disposed in between the reading unit and the discharge destination switching unit; and an image information storing unit that temporarily stores the read image data before the defect determination process is performed. With that, the defect determination process is performed in an asynchronous manner with respect to the conveying of the printed material. That makes it possible to perform the defect determination process having a high degree of freedom in terms of time. As a result, it becomes possible to invest an arbitrary amount of time for inspecting images without hindering the continuous operation of image formation (see Japanese Patent Application Laid-open No. 2009-230046).

However, in the technology disclosed in Japanese Patent Application Laid-open No. 2010-041430, the only countermeasure is to reduce the conveying speed of the printed material to be inspected. Consequently, the productivity of printed materials also decreases. That is, the specified productivity cannot be maintained. Moreover, in the technology disclosed in Japanese Patent Application Laid-open No. 2009-230046, the printed material to be inspected is temporarily stored in the printed material storing unit. Consequently, the specified productivity cannot be maintained as is the case for the technology disclosed in Japanese Patent Application Laid-open No. 2010-041430.

Therefore, there is a need for an image forming system capable of accurately separating a discharge destination for normal printed materials from a discharge destination for defective printed materials while maintaining the productivity of printed materials.

SUMMARY OF THE INVENTION

It is an object of the present invention to at least partially solve the problems in the conventional technology.

According to an embodiment, there is provided an image forming system that includes an image forming apparatus; an image inspection device connected to the image forming apparatus; a discharge device connected to the image inspection device; an image forming unit configured to output image data onto a recording medium; a first conveying unit configured to convey the recording medium onto which the image data has been output; a reading unit configured to read an image from the recording medium that is conveyed; a defect determining unit configured to determine whether the read image has a defect; a plurality of conveying paths arranged to convey the recording medium whose image has been read, the conveying paths having different lengths; a device connection determining unit configured to determine whether, at a downstream side of the image inspection device in a direction in which the recording medium is conveyed, the discharge device is directly connected to the image inspection device without another device in between or is connected to the image inspection device via another device; a second conveying unit configured to convey the recording medium to the discharge device by using a longer conveying path from among the plurality of conveying paths, when the discharge device is directly connected to the image inspection device at the downstream side without another device in between; a defective recording medium discharge tray unit to which the recording medium having a defective image output thereon is discharged; a normal recording medium discharge tray unit to which the recording medium having a non-defective image output thereon is discharged; and a discharging unit configured to discharge the recording medium to the defective recording medium discharge tray unit, when the read image is determined to have a defect, and discharge the recording medium to the normal recording medium discharge tray unit, when the read image is determined to have no defect.

According to another embodiment, there is provided an image forming system that includes an image forming apparatus; an image inspection device connected to the image forming apparatus; an image forming unit configured to output image data onto a recording medium; a first conveying unit configured to convey the recording medium onto which the image data has been output; a reading unit configured to read an image from the recording medium that is conveyed; a conveying path including a first reverse path for reversing the recording medium whose image has been read and a second reverse path for reversing the recording medium that has been reversed in the first reverse path; a defect determining unit configured to determine whether the read image has a defect while the recording medium is in the second reverse path; and a second conveying unit configured to convey the recording medium to a discharge destination based on a determination result by the defect determining unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming system according to the present invention are described in detail below with reference to the accompanying drawings.

First Embodiment

Figure 1:
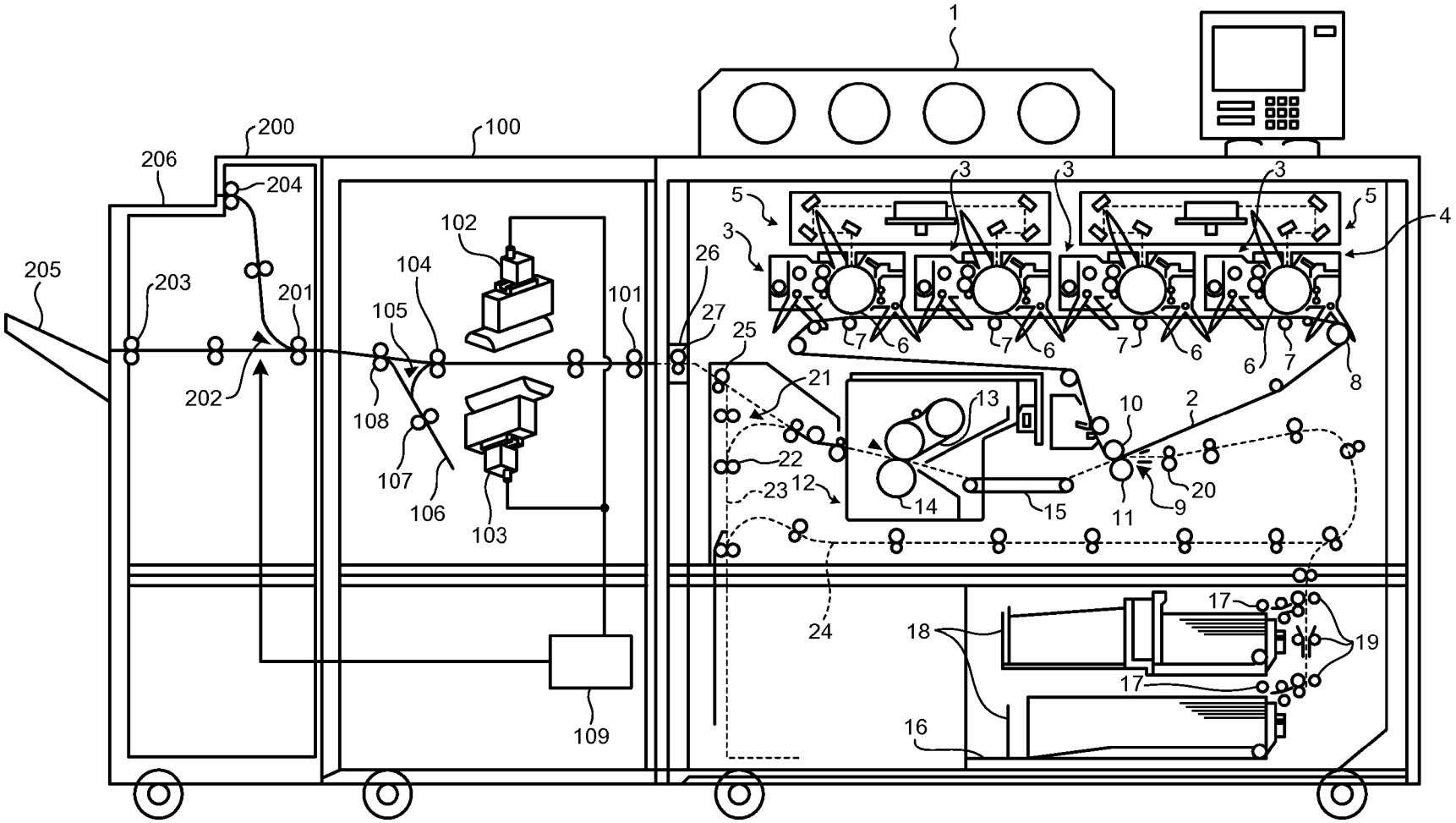
FIG. 1 is a configuration diagram illustrating an example of an image forming system according to a first embodiment.

FIG. 1 is a configuration diagram illustrating an example of an image forming system according to a first embodiment. The image forming system illustrated in FIG. 1 includes an image forming apparatus 1; an image inspection device 100 that is connected to the image forming apparatus 1; and a post-processing device 200 (a discharge device: a device which includes a discharge destination for defective printed materials) that is connected to the image inspection device 100. Herein, the post-processing device 200 is directly connected to the image inspection device 100 at the downstream side of the printed material conveying direction in the image inspection device 100.

In the first embodiment described below, the configuration is such that, to the image inspection device 100, the post-processing device 200 is connected as the device which includes a discharge destination for defective printed materials. However, any other device which includes a discharge destination for defective printed materials can be connected to the image inspection device 100. Meanwhile, the image forming apparatus 1 according to the first embodiment can be applied to a multifunction peripheral that has at least two functions from among the copying function, the printing function, the scanning function, and the facsimileing function; or can be applied to an image forming apparatus such as a copying machine or a printer that outputs (prints) image data. Explained below with reference to FIG. 1 is a configuration and operations of the image forming system.

Firstly, the explanation is given regarding the image forming apparatus 1. Near the central portion in the image forming apparatus 1 is disposed an intermediate transfer belt 2, which is an endless belt. The intermediate transfer belt 2 is wound around a plurality of support rollers in such a way that the intermediate transfer belt 2 can rotate in the clockwise direction with reference to FIG. 1. Above the intermediate transfer belt 2 is configured a tandem-type image forming device 4 in which a plurality of image forming units 3 is horizontally arranged along the conveying direction of the intermediate transfer belt 2. Moreover, as illustrated in FIG. 1, above the tandem-type image forming device 4 are disposed exposure devices 5.

Each image forming unit 3 of the tandem-type image forming device 4 includes a photosensitive drum 6 that serves as an image conveying member for conveying toner images of a particular color. The positions at which toner images are transferred from the photosensitive drums 6 onto the intermediate transfer belt 2 are called primary transfer positions. At each primary transfer position, a primary transfer roller 7 is disposed opposite to the corresponding photosensitive drum 6 and across the intermediate transfer belt 2. The primary transfer rollers 7 constitute a primary transfer unit. Meanwhile, a support roller 8 is a driving roller that rotary-drives the intermediate transfer belt 2.

On the opposite side of the tandem-type image forming device 4 and across the intermediate transfer belt 2, a secondary transfer device 9 is disposed. In the example illustrated in FIG. 1, in the secondary transfer device 9, a secondary transfer roller 11 is pressed against a secondary transfer-facing roller 10, and a transfer electric field is applied therebetween. As a result, an image formed on the intermediate transfer belt 2 is transferred onto a recording member (recording medium) (not illustrated). In the secondary transfer device 9, depending on the recording member, changes are made in the transfer current of the secondary transfer roller 11 that serves as a transfer condition parameter.

Alongside the secondary transfer device 9 is disposed a fixing mechanism 12 that performs thermal fusion adhesion of the transferred image (toner image) that has been transferred onto the recording member. The fixing mechanism 12 includes a halogen lamp (not illustrated) functioning as a heat source; and includes a pressure roller 14 pressed against a fixing belt 13 that is an endless belt.

In the fixing mechanism 12, depending on the recording member, changes are made to the following transfer condition parameters: the temperature of the fixing belt 13 and the temperature of the pressure roller 14; the nip width between the fixing belt 13 and the pressure roller 14; and the speed of the pressure roller 14. The recording member on which an image has been transferred is conveyed to the fixing mechanism 12 by a conveying belt 15.

Regarding the operations performed by the image forming apparatus 1, firstly, image data is sent to the image forming apparatus 1. Upon receiving a signal as an instruction to start the operations, a driving motor (not illustrated) rotary-drives the support roller 8. As a result, a plurality of other support rollers gets driven, thereby resulting in the rotation of the intermediate transfer belt 2. At the same time, each image forming unit 3 forms a monochromatic image on the corresponding photosensitive drum 6. Then, due to the rotation of the intermediate transfer belt 2, the monochromatic images are sequentially transferred onto the intermediate transfer belt 2 at the respective primary transfer rollers 7. Consequently, a composite color image gets formed on the intermediate transfer belt 2.

Meanwhile, in a paper feeding table 16, when one of two paper feeding rollers 17 is selectively rotated, a recording member gets fed from one of paper feeding cassettes 18 and is conveyed by carriage rollers 19. Then, the recording member reaches a registration roller 20 and stops thereat. At the same timing at which a composite color image formed on the intermediate transfer belt 2 reaches the secondary transfer device 9, the registration roller 20 is rotated so that the composite color image gets transferred onto the recording member at the secondary transfer device 9. As a result, a color image is formed on the recording member.

After the image is transferred, the secondary transfer device 9 sends the recording member to the fixing mechanism 12, which applies heat and pressure to perform fusion adhesion of the transfer image. Then, in the case of performing duplex printing in which an image is printed not only on the first side of the recording member but also on the second side that is the reverse side of the first side; the recording member is conveyed to a paper reverse path 23 and a duplex conveying path 24 by a branching claw 21 and a flip roller 22. Subsequently, in the same manner as described above, a composite color image is formed on the reverse side of the recording member.

If a recording member is to be reversed, the branching claw 21 conveys the recording member to the paper reverse path 23; and the flip roller 22 conveys the recording member toward a discharge roller 25. As a result, the recording member gets reversed and the front side becomes the rear side and vice versa. On the other side, if a recording member is not to be reversed, the branching claw 21 conveys the recording member to a discharge conveying path that is the path for conveying the recording member toward the discharge roller 25.

Then, the discharge roller 25 conveys the recording member to a de-curler unit 26. Then, depending on the recording member, a de-curler amount serving as a paper feeding evaluation parameter is altered in the de-curler unit 26. The de-curler amount is adjusted by changing the pressure of a de-curler roller 27, which conveys the recording member to the image inspection device 100. Meanwhile, once a recording member has an image formed (printed) thereon, it is a printed material.

Given below is the explanation regarding the image inspection device 100. Herein, in the image inspection device 100, an inlet roller 101 conveys a printed material to reading units 102 and 103. Then, each of the reading units 102 and 103 reads the composite color image recorded on one of the sides of the printed material. More particularly, the reading unit 102 is positioned above the printed material being conveyed and reads the image recorded on the upper surface of the printed material; the reading unit 103 is positioned below the printed material being conveyed and reads the image recorded on the lower surface of the printed material.

Then, a defect determining unit 109 determines whether or not there are defects (determines the presence or absence of defects) in the composite color images which have been read. That is, the defect determining unit 109 determines whether a printed material is a normal printed material not having defective images printed thereon or a defective printed material having defective images printed thereon. In the image forming system illustrated in FIG. 1, the post-processing device 200, which includes a discharge destination for defective printed materials, is directly connected to the image inspection device 100 at the downstream side of the printed material conveying direction in the image inspection device 100. For that reason, a printed material from which images have been read is conveyed to the post-processing device 200 using an inversion conveying path that passes through a reverse path 106. That is, an outlet roller 104 and a branching claw 105 convey the printed material to the reverse path 106 so that the printed material is reversed. Then, a flip roller 107 and a discharge roller 108 convey the reversed printed material to the post-processing device 200.

Given below is the explanation regarding the post-processing device 200. Herein, the post-processing device 200 obtains the determining result of the defect determining unit 109. If the determining result indicates that there are defects in the images which have been read, the post-processing device 200 switches a branching claw 202 so that the printed material (the defective printed material) is discharged to a defective printed material discharge tray 206. On the other hand, if the determining result indicates that there is no defect in the images which have been read, the post-processing device 200 switches the branching claw 202 so that the printed material (the normal printed material) is discharged to a normal printed material discharge tray 205.

Thus, while discharging a printed material as a normal printed material; an inlet roller 201, the branching claw 202, and a discharge roller 203 discharge the printed material to the normal printed material discharge tray 205. In contrast, while discharging a printed material as a defective printed material; the inlet roller 201, the branching claw 202, and a discharge roller 204 discharge the printed material to the defective printed material discharge tray 206.

Figure 2:
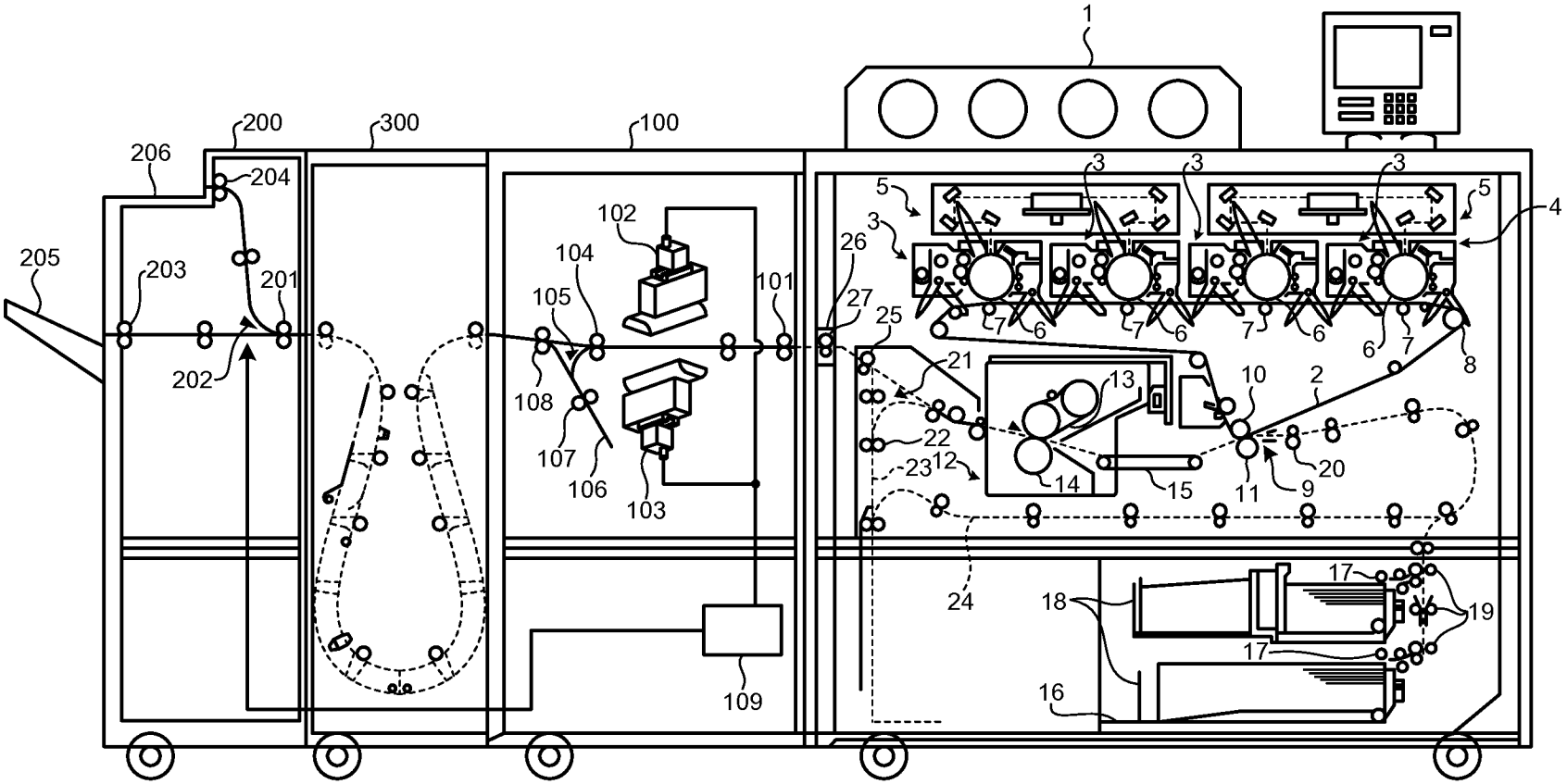
FIG. 2 is a configuration diagram illustrating another example of the image forming system according to the first embodiment.

Given below is the explanation regarding another example of the image forming system according to first embodiment. FIG. 2 is a configuration diagram illustrating another example of the image forming system according to the first embodiment. In FIG. 1, the post-processing device 200 is directly connected to the image inspection device 100 at the downstream side of the printed material conveying direction in the image inspection device 100. FIG. 2 illustrates a configuration example for a case in which the post-processing device 200 is connected to the image inspection device 100 at the downstream side of the printed material conveying direction in the image inspection device 100 via a paper cooling device 300. The image forming system illustrated in FIG. 2 includes the image forming apparatus 1; the image inspection device 100 that is connected to the image forming apparatus 1; the paper cooling device 300 (a device which does not include a discharge destination for defective printed materials) that is connected to the image forming apparatus 1; and the post-processing device 200 (a discharge device: a device which includes a discharge destination for defective printed materials) that is connected to the paper cooling device 300.

In the configuration described below according to first embodiment, to the image inspection device 100, a paper cooling device is connected as the device which does not include a discharge destination for defective printed materials. However, any other device which does not include a discharge destination for defective printed materials can be connected to the image inspection device 100. Explained below with reference to FIG. 2 is a configuration and operations of the image forming system.

The constituent elements of the image forming apparatus 1 illustrated in FIG. 2 have configurations and relations of connection identical to the image forming apparatus 1 illustrated in FIG. 1. Moreover, the constituent elements of the image forming apparatus 1 illustrated in FIG. 2 function in the same manner as in the image forming apparatus 1 illustrated in FIG. 1. Thus, in the image forming apparatus 1 illustrated in FIG. 2, a composite color image is recorded on the recording member and the de-curler roller 27 conveys the recording member to the image inspection device 100. Therefore, the detailed explanation of the image forming apparatus 1 is not repeated.

Furthermore, since the image inspection device 100 has the same functions as described with reference to FIG. 1, the constituent elements thereof are referred to by the same reference numerals and the explanation thereof is not repeated. In the image forming system illustrated in FIG. 2, the post-processing device 200 is connected to the image inspection device 100 at the downstream side of the printed material conveying direction in the image inspection device 100 via the paper cooling device 300, which does not include a discharge destination for defective printed materials. For that reason, a printed material from which images have been read is conveyed to the paper cooling device 300 using a normal conveying path that does not pass through the reverse path 106. That is, the outlet roller 104, the flip roller 107 and the discharge roller 108 convey the printed material without inversion to the paper cooling device 300.

Meanwhile, since post-processing device 200 has the same functions as described with reference to FIG. 1, the constituent elements thereof are referred to by the same reference numerals and the explanation thereof is not repeated.

Figure 3:
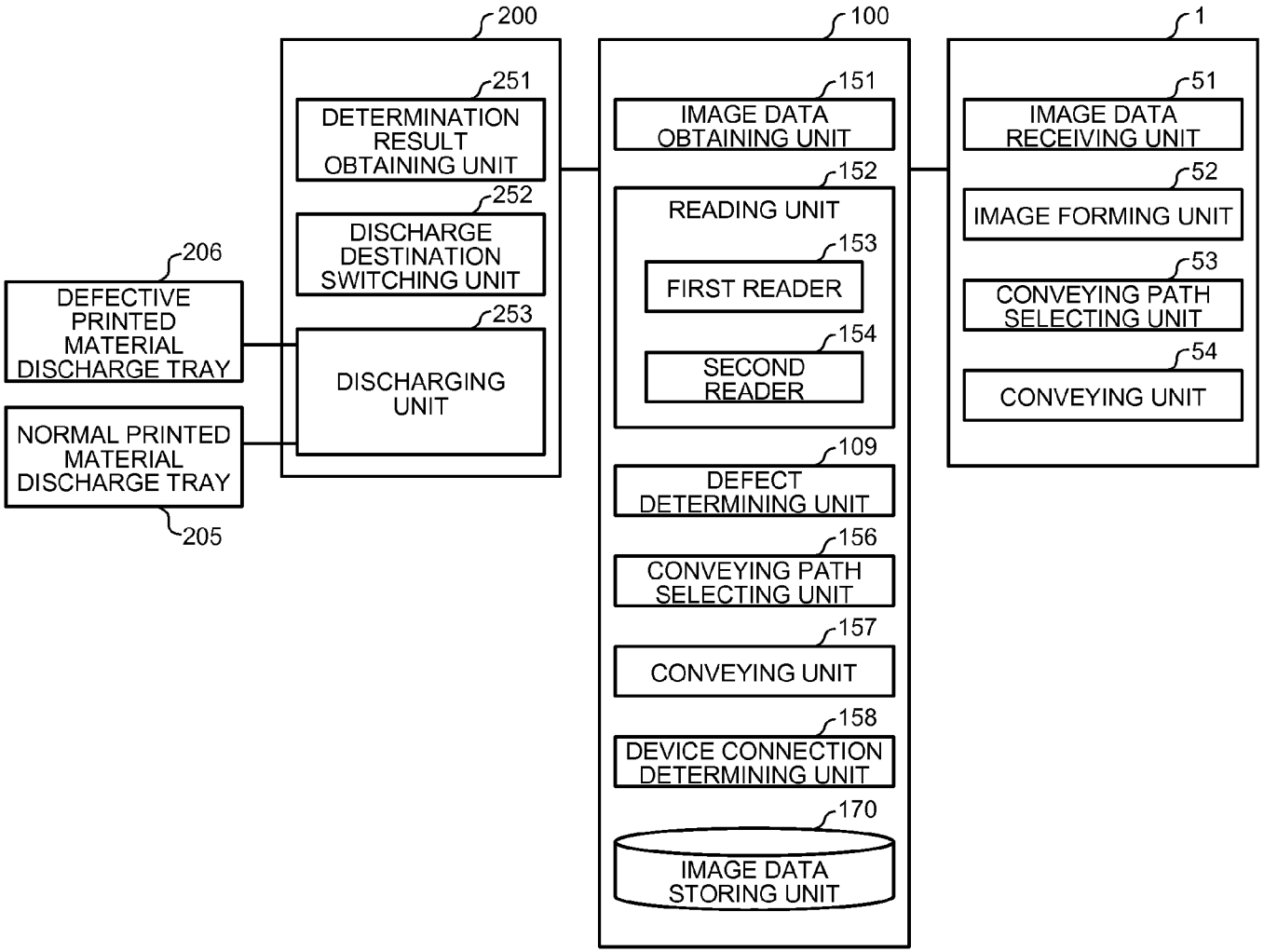
FIG. 3 is a block diagram illustrating a functional configuration of the image forming system illustrated in FIG. 1.

Given below is the explanation regarding a configuration of the image forming system illustrated in FIG. 1. FIG. 3 is a block diagram illustrating an example of the functional configuration of the image forming system illustrated in FIG. 1. As illustrated in FIG. 3, the image forming system illustrated in FIG. 1 includes the image forming apparatus 1, the image inspection device 100, and the post-processing device 200.

The image forming apparatus 1 includes an image data receiving unit 51, an image forming unit 52, a conveying path selecting unit 53, and a conveying unit 54.

The image data receiving unit 51 receives the image data that is to be printed on the recording member. Regarding the method by which the image data receiving unit 51 receives image data; for example, the image data receiving unit 51 receives image data from a personal computer (PC) that is connected to the image forming apparatus 1 via a network. Then, the image data receiving unit 51 performs a predetermined analysis with respect to the received image data, converts the received image data into image data for printing (for example, into bitmap data), and sends the image data for printing to the image inspection device 100.

Once the image data receiving unit 51 receives image data; the image forming unit 52 prints the received image data on the recording member using the tandem-type image forming device 4, the exposure devices 5, the intermediate transfer belt 2, and the fixing mechanism 12.

The conveying path selecting unit 53 selects, from a plurality of conveying paths laid in the image forming apparatus 1, a conveying path for conveying the printed material on which the image data is already printed by the image forming unit 52. The conveying path selecting unit 53 selects a conveying path on the basis of a determination result and a print condition sent by a device connection determining unit 158 (described later). Herein, the conveying paths laid in the image forming apparatus 1 include, firstly, a discharge conveying path in which the branching claw 21 conveys the printed material toward the discharge roller 25, and then the discharge roller 25 and the de-curler unit 26 convey the printed material to the image inspection device 100. Other than that, the conveying paths include the paper reverse path 23 in which the branching claw 21 conveys the printed material toward the flip roller 22, and then the flip roller 22 conveys the printed material toward the discharge roller 25. With that, the upper surface and the lower surface of the printed material are reversed. Then, the discharge roller 25 and the de-curler unit 26 convey the printed material to the image inspection device 100.

Regarding the conveying path selecting unit 53; more particularly, when the post-processing device 200 is directly connected to the image inspection device 100 at the downstream side of the printed material conveying direction in the image inspection device 100 in the image forming system (see FIG. 1) and when single-sided printing is performed followed by discharging the printed material with the first side thereof (i.e., the side on which an image is printed) facing down; the conveying path selecting unit 53 selects a discharge conveying path in which the printed material is conveyed to the image inspection device 100 without being reversed.

Alternatively, when the post-processing device 200 is directly connected to the image inspection device 100 at the downstream side of the printed material conveying direction in the image inspection device 100 in the image forming system (see FIG. 1) and when single-sided printing is performed followed by discharging the printed material with the first side thereof (i.e., the side on which an image is printed) facing up; the conveying path selecting unit 53 selects the paper reverse path 23 in which the printed material is conveyed to the image inspection device 100 after being reversed.

Still alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing down; the conveying path selecting unit 53 selects the paper reverse path 23 in which the printed material is conveyed to the image inspection device 100 after being reversed.

Still alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing up; the conveying path selecting unit 53 selects a discharge conveying path in which the printed material is conveyed to the image inspection device 100 without being reversed.

Moreover, the conveying path selecting unit 53 selects a conveying path for conveying the recording member on which image data is printed by the image forming unit 52. More particularly, in the case of duplex printing, after an image is printed on the first side of the recording member, the conveying path selecting unit 53 selects the duplex conveying path 24 for conveying the recording member.

The conveying unit 54 conveys the printed material, which has an image printed thereon, to the image inspection device 100 using the conveying path (the discharge conveying path or the paper reverse path 23) that is selected by the conveying path selecting unit 53. Moreover, in the case of duplex printing, the conveying unit 54 conveys the recording member to the duplex conveying path 24 that is selected by the conveying path selecting unit 53.

The image inspection device 100 includes an image data storing unit 170, an image data obtaining unit 151, a reading unit 152, the defect determining unit 109, a conveying path selecting unit 156, a conveying unit 157, and the device connection determining unit 158.

The image data storing unit 170 is a memory medium such as a hard disk drive or a memory that is used to store image data that the image forming apparatus 1 prints. The image data obtaining unit 151 obtains the image data sent by the image data receiving unit 51, and stores it in the image data storing unit 170.

The reading unit 152 obtains the images printed on the printed material that is conveyed from the image forming apparatus 1. Moreover, the reading unit 152 includes a first reader 153 and a second reader 154.

The first reader 153 makes use of the reading unit 102, which is disposed above the printed material being conveyed, to read from above the image printed on the upper surface of the printed material. More particularly, when the post-processing device 200 is directly connected to the image inspection device 100 at the downstream side of the printed material conveying direction in the image inspection device 100 in the image forming system (see FIG. 1) and when single-sided printing is performed to print an image on the first side of the recording member followed by discharging the printed material with the first side thereof facing down; the first reader 153 reads the image printed on the first side, that is, the upper surface of the printed material.

Alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing down; the first reader 153 reads the image printed on the first side, that is, the upper surface of the printed material.

Still alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing up; the first reader 153 reads the image printed on the second side, that is, the upper surface of the printed material.

The second reader 154 makes use of the reading unit 103, which is disposed below the printed material being conveyed, to read from below the image printed on the lower surface of the printed material. More particularly, when the post-processing device 200 is directly connected to the image inspection device 100 at the downstream side of the printed material conveying direction in the image inspection device 100 in the image forming system (see FIG. 1) and when single-sided printing is performed followed by discharging the printed material with the first side thereof (i.e., the side on which an image is printed) facing up; the second reader 154 reads the image printed on the first side, that is, the lower surface of the printed material.

Alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing down; the second reader 154 reads the image printed on the second side, that is, the lower surface of the printed material.

Still alternatively, when the post-processing device 200 is directly connected to the image inspection device 100 at the downstream side of the printed material conveying direction in the image inspection device 100 in the image forming system (see FIG. 1) and when duplex printing is performed followed by discharging the printed material with the first side thereof (i.e., the side on which an image is printed) facing up; the second reader 154 reads the image printed on the first side, that is, the lower surface of the printed material.

The defect determining unit 109 determines the presence or absence of defects in the images obtained by the reading unit 152. For example, the defect determining unit 109 compares the image data read by the reading unit 152 with the image data that is the original image data of the printed material and that is stored in the image data storing unit 170; extracts the difference in the two sets of image data; and determines whether the extracted difference is greater or smaller than a predetermined threshold value so as to determine the presence or absence of defects in the images printed on the printed material. Meanwhile, an original image of the printed material is in the CMYK format, while the image data that is read is in the RGB format. Hence, the defect determining unit 109 first performs conversion and standardizes the image data to one of the formats and then determines the presence or absence of defects in the images printed on the printed material. Then, the defect determining unit 109 sends the determination result to the post-processing device 200.

The device connection determining unit 158 determines whether the post-processing device 200, which includes a discharge destination for defective printed materials, is directly connected to the image inspection device 100 at the downstream side of the printed material conveying direction in the image inspection device 100 or is connected to the image inspection device 100 at the downstream side of the printed material conveying direction in the image inspection device 100 via the paper cooling device 300, which does not include a discharge destination for defective printed materials. Then, the device connection determining unit 158 sends the determination result to the image forming apparatus 1. With reference to FIG. 3, the device connection determining unit 158 determines that the post-processing device 200 is directly connected to the image inspection device 100 at the downstream side of the printed material conveying direction in the image inspection device 100. Meanwhile, the device connection determining unit 158 can be disposed inside the image forming apparatus 1.

Based on the determination result of the device connection determining unit 158, the conveying path selecting unit 156 selects, from among the conveying paths laid in the image inspection device 100, a conveying path for conveying the printed material from which the image data has been read by the reading unit 152. Herein, the conveying paths laid in the image inspection device 100 include, firstly, a normal conveying path (a shorter conveying path) in which the outlet roller 104, the branching claw 105, and the discharge roller 108 convey the printed material to the post-processing device 200. Other than that, the conveying paths include an inversion conveying path (a longer conveying path) in which the outlet roller 104 and the branching claw 105 convey the printed material to the reverse path 106 so that the printed material is reversed, and then the flip roller 107 and the discharge roller 108 convey the reversed printed material to the post-processing device 200.

More particularly, as illustrated in FIG. 3, when the post-processing device 200 is directly connected to the image inspection device 100 at the downstream side of the printed material conveying direction in the image inspection device 100 in the image forming system (see FIG. 1), the conveying path selecting unit 156 selects the inversion conveying path in which the printed material is reversed in the reverse path 106 and then conveyed to the post-processing device 200.

The conveying unit 157 sends the printed material, from which the image data has been read by the reading unit 152, to the post-processing device 200 using the conveying path (the normal conveying path or the inversion conveying path) that is selected by the conveying path selecting unit 156.

Meanwhile, when the post-processing device 200 is directly connected to the image inspection device 100 at the downstream side of the printed material conveying direction in the image inspection device 100, the time taken by the conveying unit 157 to reverse a printed material using the inversion conveying path is longer than the time taken by the defect determining unit 109 to determine the presence or absence of defects in the images which have been read.

In the image inspection device 100 according to the first embodiment, two conveying paths (the normal conveying path and the inversion conveying path) are laid. However, alternatively, it is also possible to have three or more conveying paths. In a configuration in which three or more conveying paths are laid, when a post-processing device is directly connected at the downstream side of the printed material conveying direction, the purpose is served as long as the printed material is conveyed using such a conveying path in which the time taken for conveying the printed material is longer than the time taken to determine the presence or absence of defects in the images which have been read.

The post-processing device 200 includes the normal printed material discharge tray 205, the defective printed material discharge tray 206, a determination result obtaining unit 251, a discharge destination switching unit 252, and a discharging unit 253.

The normal printed material discharge tray 205 is a tray in which a normal printed material, which has non-defective images printed thereon, is discharged. The defective printed material discharge tray 206 is the tray in which a defective printed material, which has defective images printed thereon, is discharged.

The determination result obtaining unit 251 obtains the determination result sent by the defect determining unit 109 of the image inspection device 100.

The discharge destination switching unit 252 switches the discharge destination according to the determination result obtained by the determination result obtaining unit 251. More particularly, if the determination result indicates that there are defects in the images which have been read, then the discharge destination switching unit 252 switches the branching claw 202 so that the printed material is discharged to the defective printed material discharge tray 206. On the other hand, if the determination result indicates that there is no defect in the images which have been read, then the discharge destination switching unit 252 switches the branching claw 202 so that the printed material is discharged to the normal printed material discharge tray 205.

The discharging unit 253 conveys and discharges the printed material, which has been conveyed from the image inspection device 100, to the discharge destination (either the defective printed material discharge tray 206 or the normal printed material discharge tray 205) that is set by the discharge destination switching unit 252.

Figure 4:
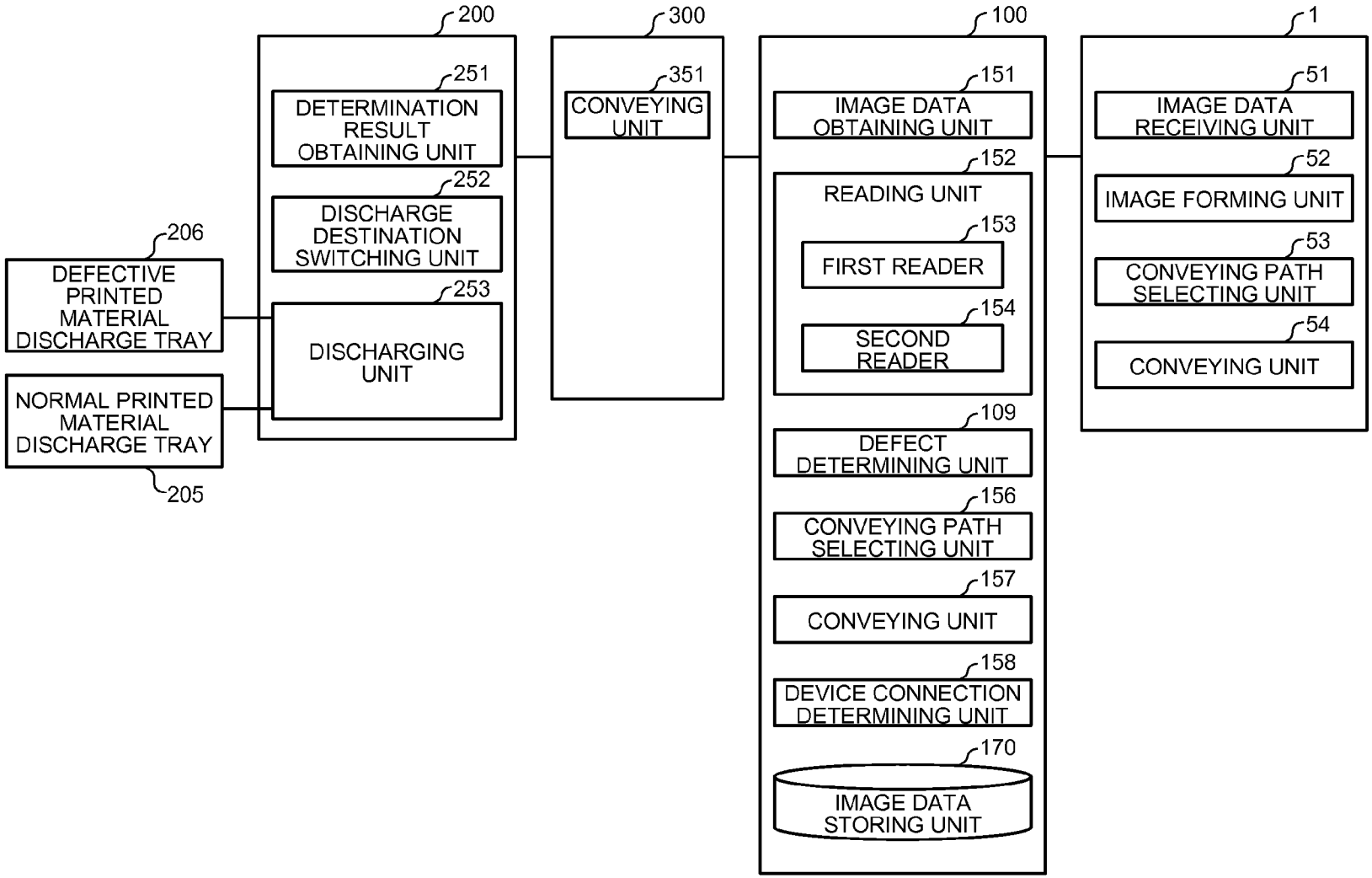
FIG. 4 is a block diagram illustrating a functional configuration of the image forming system illustrated in FIG. 2.

Given below is the explanation regarding a configuration of the image forming system illustrated in FIG. 2. FIG. 4 is a block diagram illustrating an example of the functional configuration of the image forming system illustrated in FIG. 2. As illustrated in FIG. 4, the image forming system illustrated in FIG. 2 includes the image forming apparatus 1, the image inspection device 100, the paper cooling device 300, and the post-processing device 200.

The image forming apparatus 1 includes the image data receiving unit 51, the image forming unit 52, the conveying path selecting unit 53, and the conveying unit 54. Herein, the image data receiving unit 51, the image forming unit 52, and the conveying unit 54 have the same configurations and functions as described with reference to FIG. 3. Hence, that explanation is not repeated.

In the configuration illustrated in FIG. 4 (FIG. 2), the conveying path selecting unit 53 selects a conveying path in the following manner. Herein, as a plurality of conveying paths laid in the image forming apparatus 1; the discharge conveying path and the paper reverse path 23 are laid in an identical manner to that illustrated in FIG. 3.

More particularly, when the post-processing device 200 is connected to the image inspection device 100 at the downstream side of the printed material conveying direction in the image inspection device 100 via the paper cooling device 300 in the image forming system (see FIG. 2) and when single-sided printing is performed followed by discharging the printed material with the first side thereof (i.e., the side on which an image is printed) facing down; the conveying path selecting unit 53 selects the paper reverse path 23 in which the printed material is reversed before being conveyed to the image inspection device 100.

Alternatively, when the post-processing device 200 is connected to the image inspection device 100 at the downstream side of the printed material conveying direction in the image inspection device 100 via the paper cooling device 300 in the image forming system (see FIG. 2) and when single-sided printing is performed followed by discharging the printed material with the first side thereof (i.e., the side on which an image is printed) facing up; the conveying path selecting unit 53 selects the discharge conveying path in which the printed material is conveyed to the image inspection device 100 without being reversed.

Still alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing down; the conveying path selecting unit 53 selects the discharge conveying path in which the printed material is conveyed to the image inspection device 100 without being reversed.

Still alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing up; the conveying path selecting unit 53 selects the paper reverse path 23 in which the printed material is reversed before being conveyed to the image inspection device 100.

The conveying path selecting unit 53 selects a conveying path for conveying the printed material on which the image forming unit 52 prints the image data. More particularly, in the case of duplex printing, after an image is printed on the first side of the recording member, the conveying path selecting unit 53 selects the duplex conveying path 24 for conveying the recording member.

The image inspection device 100 includes the image data storing unit 170, the image data obtaining unit 151, the reading unit 152, the defect determining unit 109, the conveying path selecting unit 156, the conveying unit 157, and the device connection determining unit 158. Herein, the image data storing unit 170, the image data obtaining unit 151, the defect determining unit 109, the conveying unit 157, and the device connection determining unit 158 have the same configurations and functions as described with reference to FIG. 3. Hence, that explanation is not repeated.

Since the reading unit 152 has the same configuration and functions as described with reference to FIG. 3, the explanation thereof is not repeated. In the configuration illustrated in FIG. 4 (FIG. 2), the first reader 153 and the second reader 154 of the reading unit 152 read images in the following manner.

The first reader 153 makes use of the reading unit 102, which is disposed above the printed material being conveyed, to read from above the image printed on the upper surface of the printed material. More particularly, when the post-processing device 200 is connected to the image inspection device 100 at the downstream side of the printed material conveying direction in the image inspection device 100 via the paper cooling device 300 in the image forming system (see FIG. 2) and when single-sided printing is performed followed by discharging the printed material with the first side thereof facing up; the first reader 153 reads the image printed on the first side, that is, the upper surface of the printed material.

Alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing down; the first reader 153 reads the image printed on the second side, that is, the upper surface of the printed material.

Still alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing up; the first reader 153 reads the image printed on the first side, that is, the upper surface of the printed material.

The second reader 154 makes use of the reading unit 103, which is disposed below the printed material being conveyed, to read from below the image printed on the lower surface of the printed material. More particularly, when the post-processing device 200 is connected to the image inspection device 100 at the downstream side of the printed material conveying direction in the image inspection device 100 via the paper cooling device 300 in the image forming system (see FIG. 2) and when single-sided printing is performed followed by discharging the printed material with the first side thereof facing down; the second reader 154 reads the image printed on the first side, that is, the lower surface of the printed material.

Alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing down; the second reader 154 reads the image printed on the first side, that is, the lower surface of the printed material.

Still alternatively, when the post-processing device 200 is connected to the image inspection device 100 at the downstream side of the printed material conveying direction in the image inspection device 100 via the paper cooling device 300 in the image forming system (see FIG. 2) and when duplex printing is performed followed by discharging the printed material with the first side thereof (i.e., the side on which an image is printed) facing up; the second reader 154 reads the image printed on the second side, that is, the lower surface of the printed material.

Since the reading unit 152 has the same configuration and functions as described with reference to FIG. 3, the explanation thereof is not repeated. In the configuration illustrated in FIG. 4 (FIG. 2), the conveying path selecting unit 156 selects a conveying path in the following manner.

More particularly, as illustrated in FIG. 4, when the post-processing device 200 is connected to the image inspection device 100 at the downstream side of the printed material conveying direction in the image inspection device 100 via the paper cooling device 300 in the image forming system (see FIG. 2), the conveying path selecting unit 156 selects the normal conveying path in which the printed material is conveyed to the post-processing device 200 without being reversed.

The paper cooling device 300 cools the printed material, which has been conveyed from the image inspection device 100, by letting the printed material pass through a conveying path laid therein. More particularly, the paper cooling device 300 includes a conveying unit 351 that allows the printed material, which has been conveyed from the image inspection device 100, to pass through a conveying path laid in the paper cooling device 300 and then reach the post-processing device 200.

The post-processing device 200 includes the normal printed material discharge tray 205, the defective printed material discharge tray 206, the determination result obtaining unit 251, the discharge destination switching unit 252, and the discharging unit 253. Herein, the normal printed material discharge tray 205, the defective printed material discharge tray 206, the determination result obtaining unit 251, the discharge destination switching unit 252, and the discharging unit 253 have the same configurations and functions as described with reference to FIG. 3. Hence, that explanation is not repeated.

Figure 5:
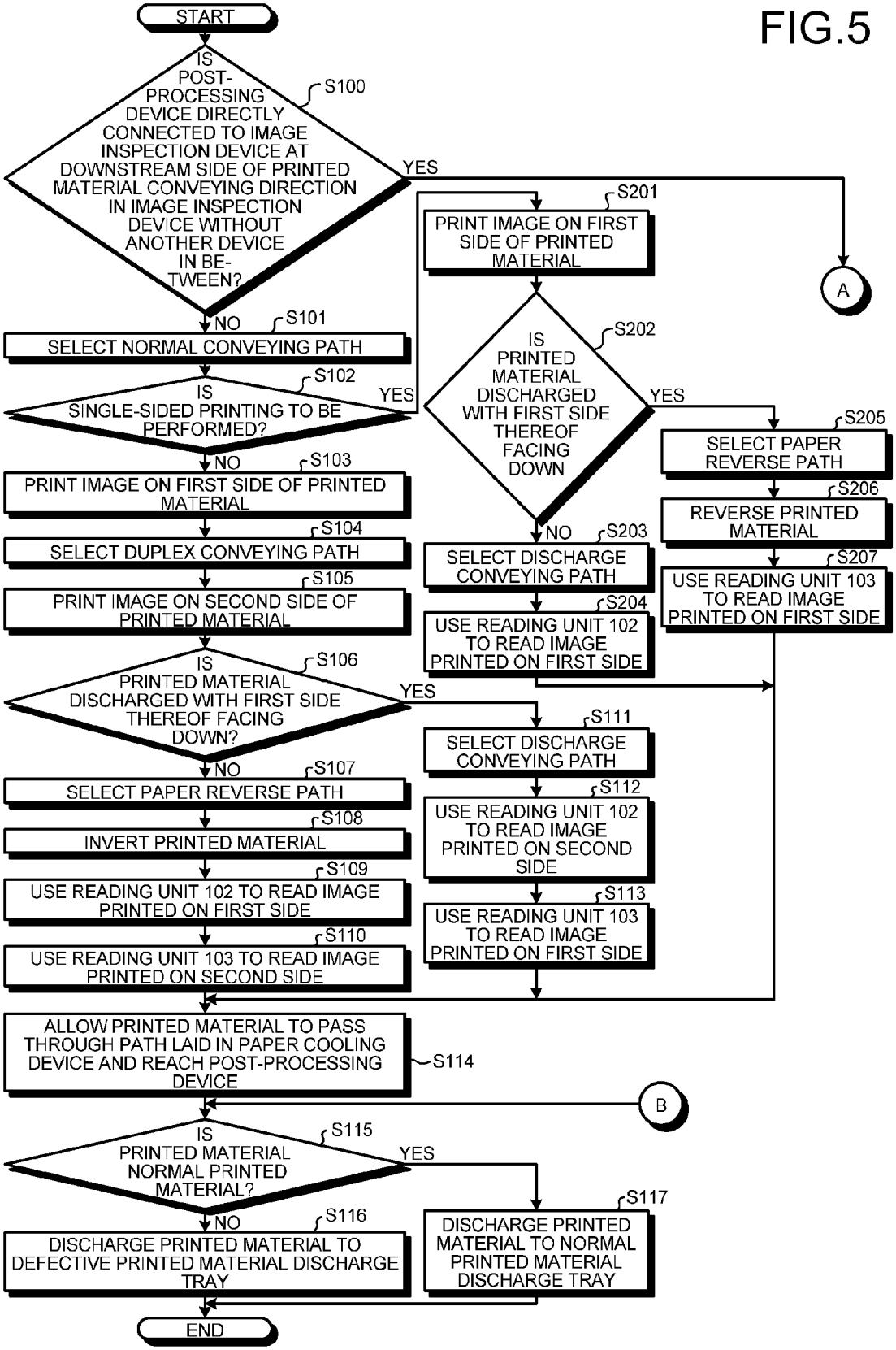
FIGS. 5 and 6 illustrate a flowchart of a printed material conveying operation performed in the image forming system according to the first embodiment.
Figure 6:
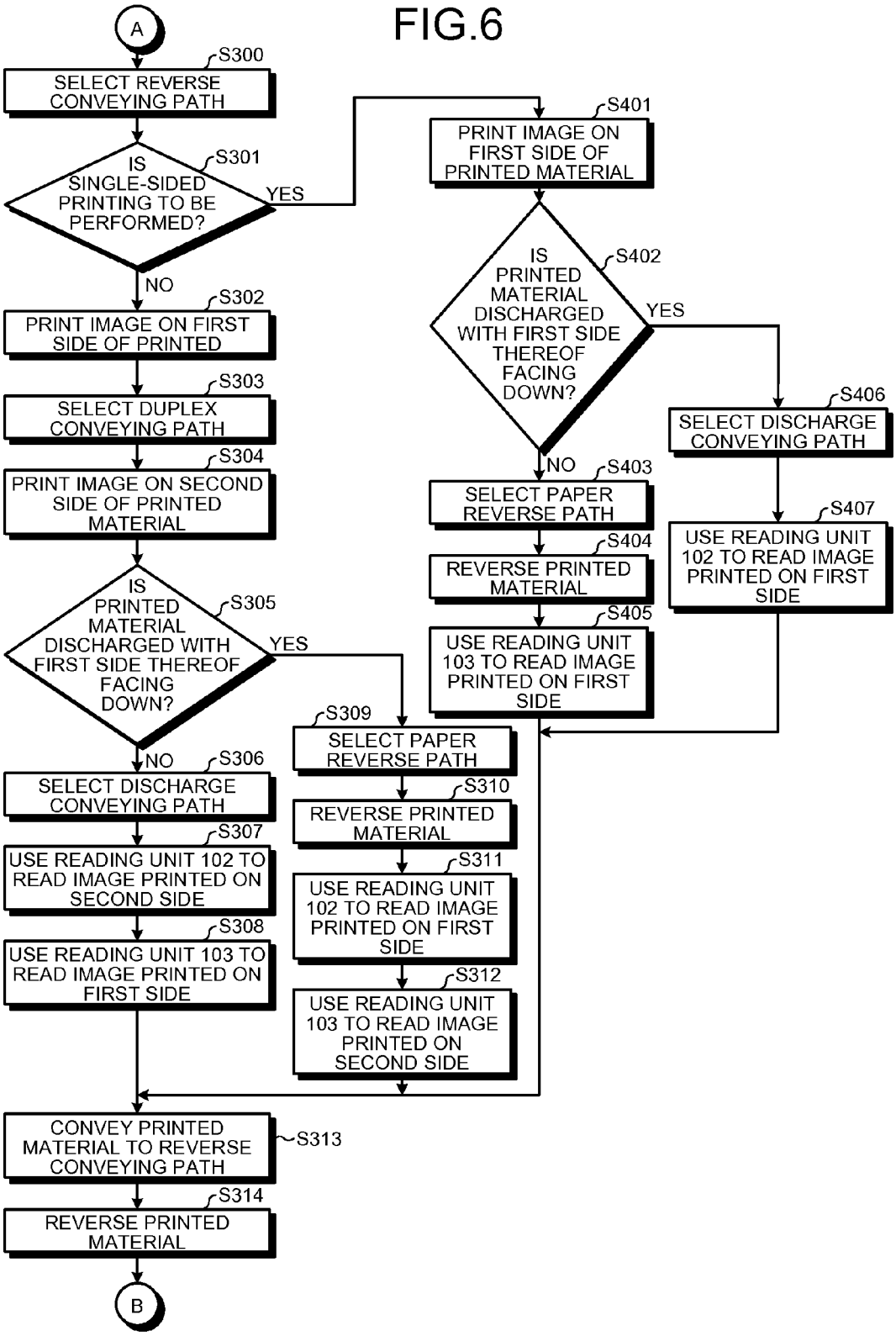

Given below is the explanation regarding a printed material conveying operation performed in the image forming system (illustrated in FIG. 1 or FIG. 2) according to the first embodiment. FIGS. 5 and 6 are flowcharts for explaining the printed material conveying operation performed in the image forming system according to the first embodiment.

Firstly, the device connection determining unit 158 of the image inspection device 100 determines whether or not the post-processing device 200 is directly connected to the image inspection device 100 at the downstream side of the printed material conveying direction in the image inspection device 100 without using another device (such as the paper cooling device 300) in between (Step S100). If the post-processing device 200 is directly connected without using another device in between (Yes at Step S100), then the system control proceeds to (A) described with reference to FIG. 6. The explanation regarding FIG. 6 is given later in detail.

On the other hand, if the post-processing device 200 is not connected without using another device in between, that is, if the post-processing device 200 is connected via the paper cooling device 300 (No at Step S100); then the conveying path selecting unit 156 selects the normal conveying path in which the printed material is conveyed to the post-processing device 200 without being reversed (Step S101).

Subsequently, the image forming unit 52 of the image forming apparatus 1 determines whether or not single-sided printing is to be performed (Step S102). That determination is performed according to a print instruction received from the user. If single-sided printing is not to be performed, that is, if duplex printing is to be performed (No at Step S102); then the image forming unit 52 firstly prints an image on the first side of a recording member (Step S103).

Then, the conveying path selecting unit 53 selects the duplex conveying path 24 for the purpose of duplex printing (Step S104), and the conveying unit 54 conveys the recording member to the duplex conveying path 24. Subsequently, the image forming unit 52 prints an image on the second side of the recording member (Step S105).

Then, the conveying path selecting unit 53 determines whether or not the recording member (printed material) is to be discharged with the first side thereof facing down (Step S106). That determination is performed according to the print instruction received from the user.

If the printed material is not to be discharged with the first side thereof facing down, that is, if the printed material is to be discharged with the first side thereof facing up (No at Step S106); then the conveying path selecting unit 53 selects the paper reverse path 23 in which the printed material is conveyed to the image inspection device 100 after being reversed (Step S107). Then, the conveying unit 54 reverses the printed material using the paper reverse path 23 (Step S108) and conveys the reversed printed material to the image inspection device 100.

The first reader 153 of the image inspection device 100 makes use of the reading unit 102 to read the image printed on the first side of the printed material (Step S109), while the second reader 154 of the image inspection device 100 makes use of the reading unit 103 to read the image printed on the second side of the printed material (Step S110). Then, the system control proceeds to Step S114.

Meanwhile, if the printed material is to be discharged with the first side thereof facing down (Yes at Step S106); then the conveying path selecting unit 53 selects the discharge conveying path in which the printed material is conveyed to the image inspection device 100 without being reversed (Step S111). Then, the conveying unit 54 conveys the printed material to the image inspection device 100 using the discharge conveying path.

Subsequently, the first reader 153 of the image inspection device 100 makes use of the reading unit 102 to read the image printed on the second side of the printed material (Step S112), while the second reader 154 of the image inspection device 100 makes use of the reading unit 103 to read the image printed on the first side of the printed material (Step S113). Then, the system control proceeds to Step S114.

Meanwhile, at Step S102, if single-sided printing is to be performed (Yes at Step S102); then the image forming unit 52 prints an image on the first side of a recording member (Step S201). Then, the conveying path selecting unit 53 determines whether or not the recording member (printed material) is to be discharged with the first side thereof facing down (Step S202). That determination is performed according to the print instruction received from the user.

If the printed material is not to be discharged with the first side thereof facing down, that is, if the printed material is to be discharged with the first side thereof facing up (No at Step S202); then the conveying path selecting unit 53 selects the discharge conveying path in which the printed material is conveyed to the image inspection device 100 without being reversed (Step S203). Then, the conveying unit 54 conveys the printed material to the image inspection device 100 using the discharge conveying path. The first reader 153 of the image inspection device 100 makes use of the reading unit 102 to read the image printed on the first side of the printed material (Step S204). Then, the system control proceeds to Step S114.

On the other hand, if the printed material is to be discharged with the first side thereof facing down (Yes at Step S202); then the conveying path selecting unit 53 selects the paper reverse path 23 in which the printed material is conveyed to the image inspection device 100 after being reversed (Step S205). Then, the conveying unit 54 reverses the printed material using the paper reverse path 23 (Step S206) and conveys the reversed printed material to the image inspection device 100. The second reader 154 of the image inspection device 100 makes use of the reading unit 103 to read the image printed on the first side of the printed material (Step S207). Then, the system control proceeds to Step S114.

Subsequently, the conveying unit 351 of the paper cooling device 300 allows the printed material to pass through a conveying path laid in the paper cooling device 300 and reach the post-processing device 200 (Step S114).

Then, according to the determination result of the defect determining unit 109 of the image inspection device 100, the discharge destination switching unit 252 of the post-processing device 200 determines whether or not the printed material that has been conveyed is a normal printed material (Step S115) and accordingly switches the conveying destination for printed materials.

If the printed material is not a normal printed material, that is, if the printed material is a defective printed material (No at Step S115); then the discharging unit 253 discharges the printed material to the defective printed material discharge tray 206 (Step S116). On the other hand, if the printed material is a normal printed material (Yes at Step S115); then the discharging unit 253 discharges the printed material to the normal printed material discharge tray 205 (Step S117). That marks the end of the operations.

Explained below with reference to FIG. 6 are the operations performed in the case when the post-processing device 200 is directly connected without using another device in between at Step S100. When the post-processing device 200 is directly connected without using another device in between (Yes at Step S100), the conveying path selecting unit 156 selects an inversion conveying path in which the printed material conveyed to the post-processing device 200 after being reversed (Step S300).

Subsequently, the image forming unit 52 of the image forming apparatus 1 determines whether or not single-sided printing is to be performed (Step S301). That determination is performed according to the print instruction received from the user. If single-sided printing is not to be performed, that is, if duplex printing is to be performed (No at Step S301); then the image forming unit 52 firstly prints an image on the first side of a recording member (Step S302).

Then, the conveying path selecting unit 53 selects the duplex conveying path 24 for the purpose of duplex printing (Step S303), and the conveying unit 54 conveys the recording member to the duplex conveying path 24. Subsequently, the image forming unit 52 prints an image on the second side of the recording member (Step S304).

Then, the conveying path selecting unit 53 determines whether or not the recording member (printed material) is to be discharged with the first side thereof facing down (Step S305). That determination is performed according to the print instruction received from the user.

If the printed material is not to be discharged with the first side thereof facing down, that is, if the printed material is to be discharged with the first side thereof facing up (No at Step S305); then the conveying path selecting unit 53 selects the discharge conveying path in which the printed material is conveyed to the image inspection device 100 without being reversed (Step S306). Then, the conveying unit 54 conveys the printed material to the image inspection device 100 using the discharge conveying path.

The first reader 153 of the image inspection device 100 makes use of the reading unit 102 to read the image printed on the second side of the printed material (Step S307), while the second reader 154 of the image inspection device 100 makes use of the reading unit 103 to read the image printed on the first side of the printed material (Step S308). Then, the system control proceeds to Step S313.

Meanwhile, at Step S305, if the printed material is to be discharged with the first side thereof facing down (Yes at Step S305); then the conveying path selecting unit 53 selects the paper reverse path 23 in which the printed material is conveyed to the image inspection device 100 after being reversed (Step S309). Then, the conveying unit 54 reverses the printed material using the paper reverse path 23 (Step S310) and conveys the reversed printed material to the image inspection device 100.

The first reader 153 of the image inspection device 100 makes use of the reading unit 102 to read the image printed on the first side of the printed material (Step S311), while the second reader 154 of the image inspection device 100 makes use of the reading unit 103 to read the image printed on the second side of the printed material (Step S312). Then, the system control proceeds to Step S313.

Meanwhile, at Step S301, if single-sided printing is to be performed (Yes at Step S301); then the image forming unit 52 prints an image on the first side of the recording member (Step S401). Then, the conveying path selecting unit 53 determines whether or not the recording member (printed material) is to be discharged with the first side thereof facing down (Step S402). That determination is performed according to the print instruction received from the user.

If the printed material is not to be discharged with the first side thereof facing down, that is, if the printed material is to be discharged with the first side thereof facing up (No at Step S402); then the conveying path selecting unit 53 selects the paper reverse path 23 in which the printed material is conveyed to the image inspection device 100 after being reversed (Step S403). Subsequently, the conveying unit 54 reverses the printed material using the paper reverse path 23 (Step S404) and conveys the reversed printed material to the image inspection device 100. Then, the second reader 154 of the image inspection device 100 makes use of the reading unit 103 to read the image printed on the first side of the printed material (Step S405). The system control then proceeds to Step S313.

On the other hand, if the printed material is to be discharged with the first side thereof facing down (Yes at Step S402); then the conveying path selecting unit 53 selects the discharge conveying path in which the printed material is conveyed to the image inspection device 100 without being reversed (Step S406). Then, the conveying unit 54 conveys the printed material to the image inspection device 100 using the discharge conveying path. The first reader 153 of the image inspection device 100 makes use of the reading unit 102 to read the image printed on the first side of the printed material (Step S407). Then, the system control proceeds to Step S313.

Subsequently, the conveying unit 157 conveys the printed material, from which the image has been read, to the inversion conveying path (Step S313); reverses the printed material using the inversion conveying path (Step S314); and conveys the reversed printed material to the image inspection device 100. Then, the system control proceeds to Step S115 illustrated in FIG. 5.

In this way, according to the first embodiment, in the image forming system in which a printed material is conveyed to the post-processing device 200 that is connected to the image inspection device 100 without using another device in between (FIG. 1); the inversion conveying path is selected in the image inspection device 100 so that the printed material, from which the images have been read, is reversed in the reverse path 106 and then conveyed to the post-processing device 200. On the other hand, according to the first embodiment, in the image forming system in which a printed material is conveyed to the post-processing device 200 that is connected to the image inspection device 100 via the paper cooling device 300 (FIG. 2); the normal conveying path is selected in the image inspection device 100 so that the printed material, from which the images have been read, is conveyed to the post-processing device 200 without being reversed.

Thus, In the image forming system illustrated in FIG. 1, the defect determining unit 109 can determine the presence or absence of defects in images while the printed material is being reversed in the reverse path 106; and the determination result can be used in ensuring that a discharge destination for normal printed materials and a discharge destination for defective printed materials are separately secured. In the image forming system illustrated in FIG. 2), even if the printed material is conveyed to the paper cooling device 300 without being reversed, the defect determining unit 109 can determine the presence or absence of defects in images while the printed material is being conveyed through the paper cooling device 300; and the determination result can be used in ensuring a discharge destination for normal printed materials and a discharge destination for defective printed materials are separately secured. Hence, it becomes possible to convey the printed material in accordance with the configuration of any of the two types of the image forming system. As a result, it becomes possible to accurately separate the discharge destination for normal printed materials from the discharge destination for defective printed materials while maintaining the productivity of printed materials.

Second Embodiment

In the first embodiment, the conveying path in an image inspection device is selected according to whether a post-processing device (a discharge device) is connected directly to the image inspection device or whether the post-processing device is connected to the image inspection device via a paper cooling device. In contrast, in a second embodiment, an image inspection device is configured to have two reverse paths, and defect determination with respect to a printed material is performed while the printed material is being reversed using the two reverse paths. Then, the conveying destination for printed materials is determined on the basis of the determination result.

Figure 7:
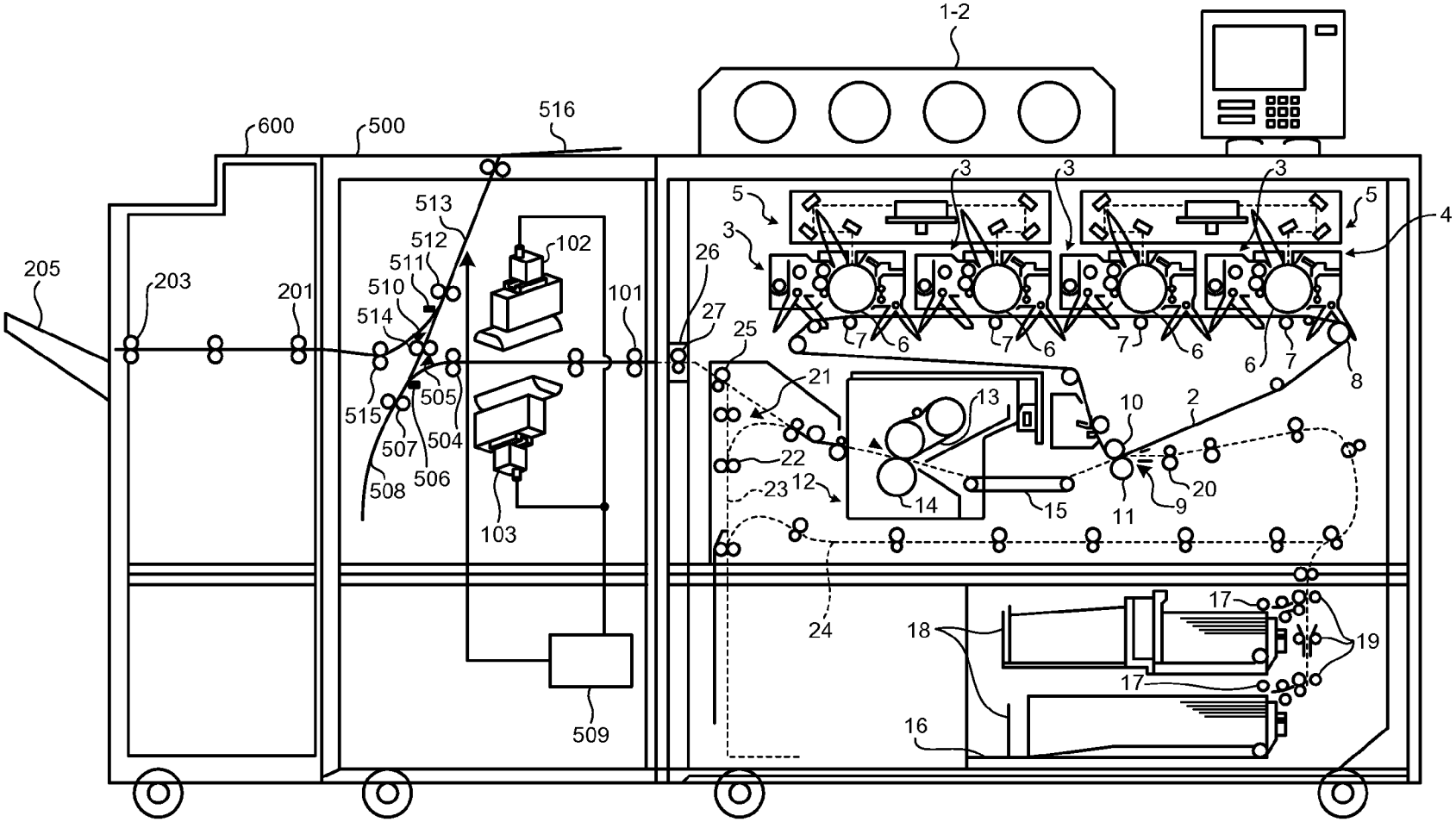
FIG. 7 is a configuration diagram illustrating an example of an image forming system according to a second embodiment.

Firstly, the explanation is given regarding an image forming system according to the second embodiment. FIG. 7 is a configuration diagram illustrating an example of the image forming system according to the second embodiment. Herein, the image forming system illustrated in FIG. 7 includes an image forming apparatus 1-2; an image inspection device 500 that is connected to the image forming apparatus 1-2; and a post-processing device 600 (a discharge device) that is connected to the image inspection device 500.

In the second embodiment described below, the configuration is such that, to the image inspection device 500, the post-processing device 600 is connected as the device which includes a discharge destination for normal printed materials. However, any other device which includes a discharge destination for normal printed materials can be connected to the image inspection device 500. Meanwhile, the image forming apparatus 1-2 according to the second embodiment can be applied to a multifunction peripheral or to an image forming apparatus such as a copying machine or a printer that outputs (prints) image data. Explained below with reference to FIG. 7 is a configuration and operations of the image forming system.

The constituent elements of the image forming apparatus 1-2 illustrated in FIG. 7 have configurations and relations of connection identical to the image forming apparatus 1 illustrated in FIG. 1. Moreover, the constituent elements of the image forming apparatus 1-2 illustrated in FIG. 7 function in the same manner as in the image forming apparatus 1 illustrated in FIG. 1. Thus, in the image forming apparatus 1-2 illustrated in FIG. 7, a composite color image is recorded on the recording member and the de-curler roller 27 conveys the recording member to the image inspection device 500. Therefore, the detailed explanation of the image forming apparatus 1-2 is not repeated.

Given below is the explanation regarding the image inspection device 500. Herein, in the image inspection device 500, the inlet roller 101 conveys a printed material to the reading units 102 and 103. Then, each of the reading units 102 and 103 reads the composite color image recorded on one of the sides of the printed material. Herein, in an identical manner to the configuration illustrated in FIG. 1, the reading unit 102 is positioned above the printed material being conveyed and reads the image recorded on the upper surface of the printed material; while the reading unit 103 is positioned below the printed material being conveyed and reads the image recorded on the lower surface of the printed material.

Then, a defect determining unit 509 determines whether or not there are defects in the composite color images which have been read. That is, the defect determining unit 509 determines whether the composite color images point to a normal printed material not having any defects or to a defective printed material having defects.

A carriage roller 504 conveys the printed material by a branching claw 505 and a running sensor 506. Then, a flip roller 507 is made to perform positive rotation so that the printed material is conveyed to a first reverse path 508 and stops thereat. Herein, positive rotation of the flip roller 507 points to rotating the flip roller 507 in a direction that enables conveying the printed material to the first reverse path 508, which is a conveying path for reversing the printed material from which images have been read.

After waiting for a period of time required by the flip roller 507 to be able to perform reverse rotation, the flip roller 507 is reverse-rotated so that the print material again passes by the branching claw 505 and is conveyed to a carriage roller 514. Then, the carriage roller 514 conveys the printed material by a branching claw 510 and a running sensor 511. Subsequently, a flip roller 512 is made to perform positive rotation so that the printed material is conveyed to a second reverse path 513 and stops thereat. Herein, positive rotation of the flip roller 512 points to rotating the flip roller 512 in a direction that enables conveying the printed material to the second reverse path 513, which is a conveying path for reversing the printed material that has been reversed once at the first reverse path 508.

If the determination result of the defect determining unit 509 indicates that there is no defect in the images which have been read, then the printed material is discharged to the normal printed material discharge tray 205 that is disposed in the post-processing device 600. In this case, the branching claw 510 and the flip roller 512 are reverse-rotated so that an outlet roller 515 conveys the printed material to the post-processing device 600.

On the other hand, if the determination result of the defect determining unit 509 indicates that there are defects in the images which have been read, then the printed material is discharged to a defective printed material discharge tray 516 that is disposed in the image inspection device 500. In this case, the flip roller 512 is made to perform positive rotation so that the printed material is conveyed to the defective printed material discharge tray 516 that is connected to the second reverse path 513.

Given below is the explanation regarding the post-processing device 600. In the post-processing device 600, when a printed material (a normal printed material) is conveyed from the image inspection device 500; the inlet roller 201 and the discharge roller 203 discharge the printed material to the normal printed material discharge tray 205.

Figure 8:
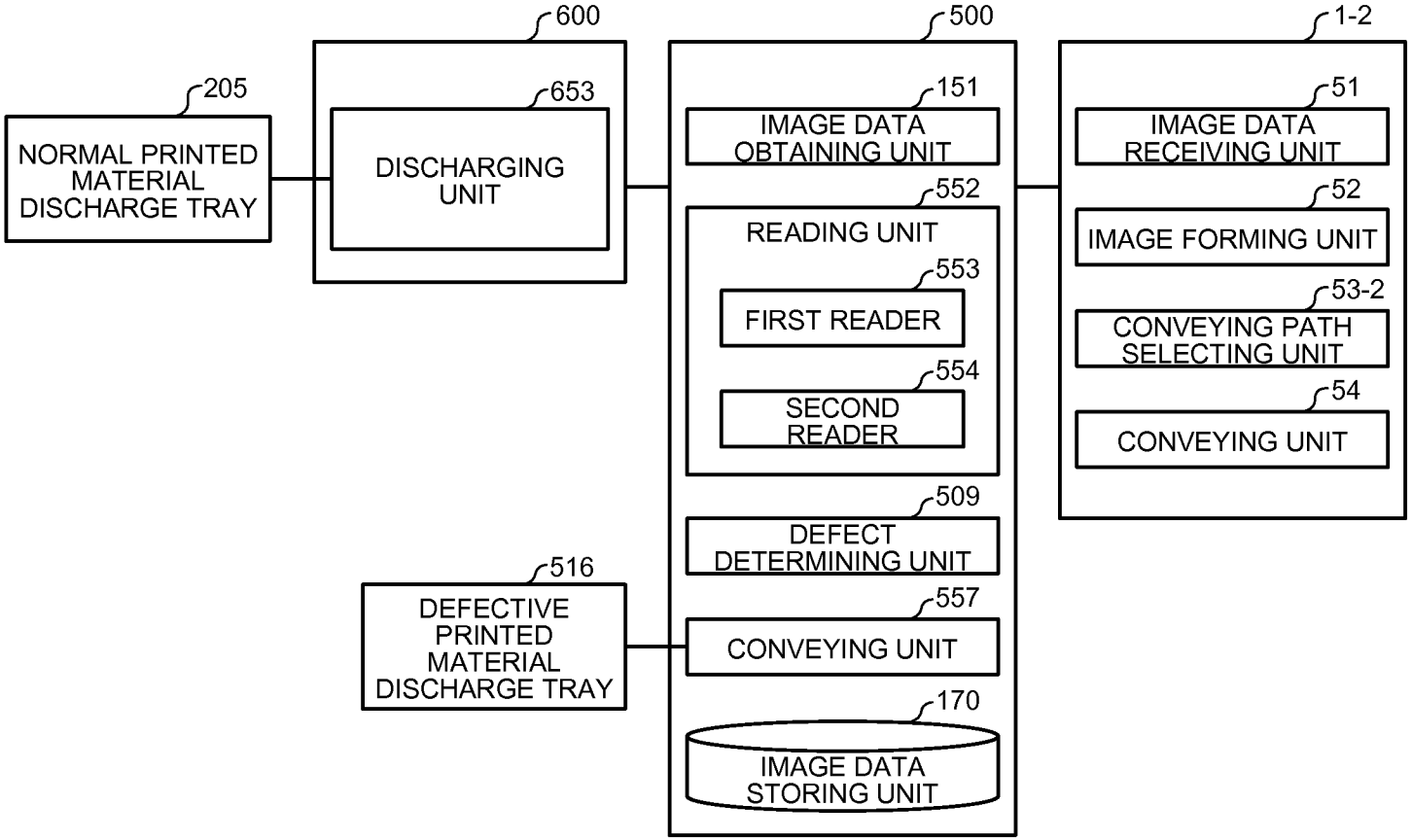
FIG. 8 is a block diagram illustrating a functional configuration of the image forming system illustrated in FIG. 7.

Given below is the explanation regarding a configuration of the image forming system illustrated in FIG. 7. FIG. 8 is a block diagram illustrating an example of the functional configuration of the image forming system illustrated in FIG. 7. As illustrated in FIG. 8, the image forming system illustrated in FIG. 7 includes the image forming apparatus 1-2, the image inspection device 500, and the post-processing device 600.

The image forming apparatus 1-2 includes the image data receiving unit 51, the image forming unit 52, a conveying path selecting unit 53-2, and the conveying unit 54. Herein, the image data receiving unit 51 and the image forming unit 52 have the same configurations and functions as described with reference to FIG. 3 according to the first embodiment. Hence, that explanation is not repeated.

The conveying path selecting unit 53-2 selects, from a plurality of conveying paths laid in the image forming apparatus 1-2, a conveying path for conveying the printed material on which the image data is already printed by the image forming unit 52. In the second embodiment, since the image inspection device 500 does not include the device connection determining unit 158; the conveying path selecting unit 53-2 selects a conveying path without referring to the determination result of the device connection determining unit 158. More particularly, while conveying to the image inspection device 500 a printed material on which the image data has been printed; the conveying path selecting unit 53-2 selects a conveying path in which the branching claw 21 conveys the printed material toward the discharge roller 25, and the discharge roller 25 and the de-curler unit 26 convey the printed material to the image inspection device 500. In the case of performing duplex printing, after an image is printed on the first side of a recording member, the conveying path selecting unit 53-2 selects the duplex conveying path 24 for conveying the recording member.

The conveying unit 54 conveys the printed material, which has an image printed thereon, to the image inspection device 500 using the conveying path that is selected by the conveying path selecting unit 53-2. Moreover, in the case of duplex printing, the conveying unit 54 conveys a recording member to the duplex conveying path 24 that is selected by the conveying path selecting unit 53-2.

The image inspection device 500 includes the defective printed material discharge tray 516, the image data storing unit 170, the image data obtaining unit 151, a reading unit 552, the defect determining unit 509, and a conveying unit 557. Herein, the image data storing unit 170 and the image data obtaining unit 151 have the same configurations and functions as described with reference to FIG. 3 according to the first embodiment. Hence, that explanation is not repeated.

The defective printed material discharge tray 516 is connected to the second reverse path 513, and serves as the tray to which is discharged a defective printed material that has defective images printed thereon.

The reading unit 552 reads the image printed on the printed material that is conveyed from the image forming apparatus 1-2. Moreover, the reading unit 552 includes a first reader 553 and a second reader 554. The first reader 553 makes use of the reading unit 102, which is disposed above the printed material being conveyed, to read from above the image printed on the upper surface of the printed material. The second reader 554 makes use of the reading unit 103, which is disposed below the printed material being conveyed, to read from below the image printed on the lower surface of the printed material.

While a printed material, from which the images have been read by the reading unit 552, is present in the second reverse path 513; the defect determining unit 509 determines whether or not there are defects in the images which have been read by the reading unit 552. The method of determining the presence or absence of defects is, for example, identical to that described in the first embodiment.

The conveying unit 557 conveys the printed material that has been conveyed from the image forming apparatus 1-2. Moreover, based on the result of determination performed by the defect determining unit 509 to determine the presence or absence of defects in the read images; the conveying unit 557 conveys the printed material, from which the images have been read by the reading unit 552, either to the defective printed material discharge tray 516 serving as the conveying destination or to the post-processing device 600 that includes the normal printed material discharge tray 205.

More particularly, if the defect determining unit 509 determines that there are defects in the images which have been read, the corresponding printed material is a defective printed material. Hence, the conveying unit 557 conveys and discharges that printed material (the defective printed material) to the defective printed material discharge tray 516 that is connected to the second reverse path 513. On the other hand, if the defect determining unit 509 determines that there is no defect in the images which have been read, the corresponding printed material is a normal printed material. Hence, the conveying unit 557 conveys and discharges that printed material (the normal printed material) to the post-processing device 600. With that, the normal printed material is discharged to the normal printed material discharge tray 205.

Meanwhile, in the image inspection device 500, the time taken by the conveying unit 557 to reverse the printed material using the first reverse path 508 and the second reverse path 513 is longer than the time taken by the defect determining unit 509 to determine the presence or absence of defects in the images which have been read.

The post-processing device 600 includes the normal printed material discharge tray 205 and a discharging unit 653.

The normal printed material discharge tray 205 is the tray to which is discharged a normal printed material that is conveyed from the image inspection device 500 and that has non-defective images printed thereon.

The discharging unit 653 discharges the printed material, which is conveyed from the image inspection device 500, to the normal printed material discharge tray 205.

Figure 9A:
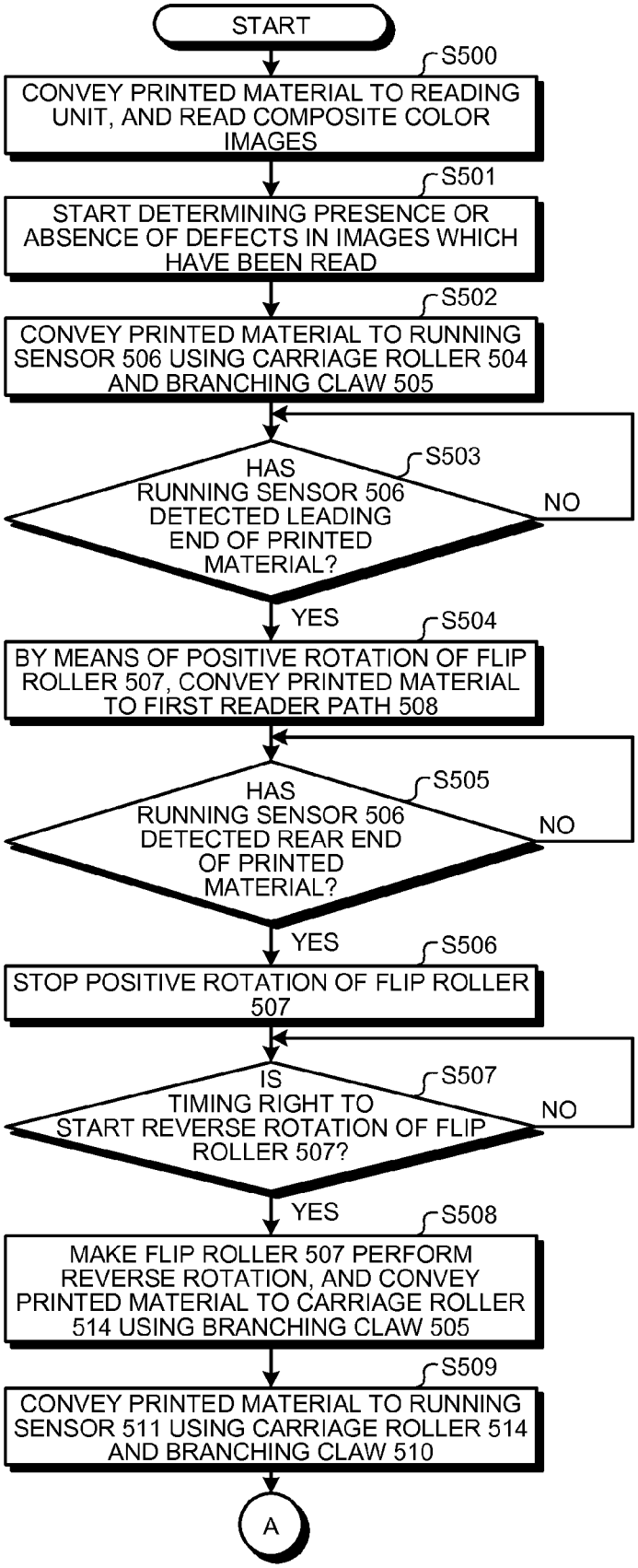
FIGS. 9A and 9B illustrate a flowchart of a printed material conveying operation performed in the image forming system according to the second embodiment.
Figure 9B:
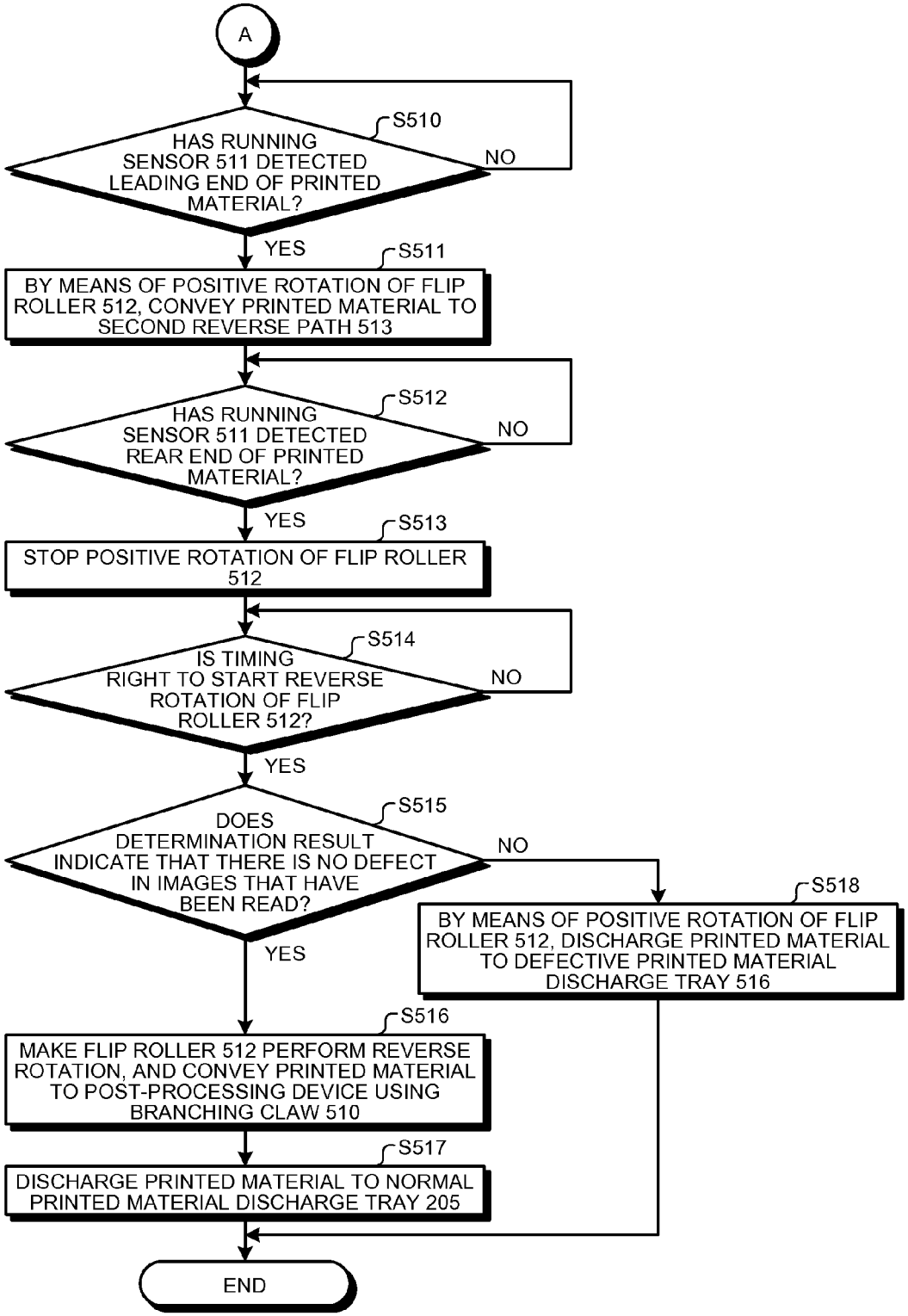

Given below is the explanation regarding a printed material conveying operation performed in the image forming system according to the second embodiment. FIGS. 9A and 9B are flowcharts for explaining the printed material conveying operation performed in the image forming system according to the second embodiment.

Firstly, in the conveying unit 557 of the image inspection device 500, the inlet roller 101 conveys a printed material to the reading units 102 and 103. Then, the reading unit 552 makes use of the reading units 102 and 103 and reads the composite color images printed on the sides (the upper surface and the lower surface) of the printed material (Step S500). Subsequently, the defect determining unit 509 starts determining the absence or presence of defects in the images which have been read (Step S501).

Then, the conveying unit 557 moves the branching claw 505 in the direction in which the printed material is to be conveyed toward the first reverse path 508; and conveys the printed material to the running sensor 506 using the carriage roller 504 and the branching claw 505 (Step S502).

The conveying unit 557 determines whether or not the running sensor 506 has detected the leading end of the printed material (Step S503). If the leading end of the printed material has not been detected (No at Step S503), then the conveying unit 557 waits until the leading end is detected. When the leading end of the printed material is detected (Yes at Step S503), the conveying unit 557 makes the flip roller 507 perform positive rotation so that the printed material is conveyed to the first reverse path 508 (Step S504).

Then, the conveying unit 557 determines whether or not the running sensor 506 has detected the rear end of the printed material (Step S505). If the rear end of the printed material has not been detected (No at Step S505), then the conveying unit 557 waits until the rear end is detected. When the rear end of the printed material is detected (Yes at Step S505), the conveying unit 557 stops the positive rotation of the flip roller 507 (Step S506).

The conveying unit 557 keeps the flip roller 507 stopped until the flip roller 507 can be subjected to reverse rotation, and determines whether or not the timing is right to start the reverse rotation of the flip roller 507 (Step S507). If the timing is not right to start the reverse rotation of the flip roller 507 (No at Step S507), then the conveying unit 557 waits until the right timing.

On the other hand, when the timing is right to start the reverse rotation of the flip roller 507 (Yes at Step S507); the conveying unit 557 makes the flip roller 507 perform reverse rotation, moves the branching claw 505 in the direction in which the printed material is to be conveyed toward the second reverse path 513, and conveys the printed material to the carriage roller 514 (Step S508).

Then, the conveying unit 557 moves the branching claw 510 in the direction in which the printed material is to be conveyed toward the second reverse path 513; and conveys the printed material to the running sensor 511 using the carriage roller 514 and the branching claw 510 (Step S509).

The conveying unit 557 determines whether or not the running sensor 511 has detected the leading end of the printed material (Step S510). If the leading end of the printed material has not been detected (No at Step S510), then the conveying unit 557 waits until the leading end is detected. When the leading end of the printed material is detected (Yes at Step S510), the conveying unit 557 makes the flip roller 512 perform positive rotation so that the printed material is conveyed to the second reverse path 513 (Step S511).

Then, the conveying unit 557 determines whether or not the running sensor 511 has detected the rear end of the printed material (Step S512). If the rear end of the printed material has not been detected (No at Step S512), then the conveying unit 557 waits until the rear end is detected. When the rear end of the printed material is detected (Yes at Step S512), the conveying unit 557 stops the positive rotation of the flip roller 512 (Step S513).

The conveying unit 557 keeps the flip roller 512 stopped until the flip roller 512 can be subjected to reverse rotation, and determines whether or not the timing is right to start the reverse rotation of the flip roller 512 (Step S514). If the timing is not right to start the reverse rotation of the flip roller 512 (No at Step S514), then the conveying unit 557 waits until the right timing.

On the other hand, when the timing is right to start the reverse rotation of the flip roller 512 (Yes at Step S514); the conveying unit 557 determines whether or not the determination result of the defect determining unit 509 indicates that there is no defect in the images which have been read (Step S515).

If the determination result indicates that there is no defect in the image, that is, if the printed material is a normal printed material (Yes at Step S515); then the conveying unit 557 makes the flip roller 512 perform reverse rotation, moves the branching claw 510 in the direction in which the printed material is to be conveyed toward the post-processing device 600, and conveys the printed material to the post-processing device 600 (Step S516). Then, the discharging unit 653 of the post-processing device 600 discharges the printed material, which is conveyed from the image inspection device 500, to the normal printed material discharge tray 205 (Step S517).

On the other hand, if the determination result indicates that there are defects in the image, that is, if the printed material is a defective printed material (No at Step S515); then the conveying unit 557 makes the flip roller 512 perform positive rotation so that the printed material (the defective printed material) is discharged to the defective printed material discharge tray 516 (Step S518).

In this way, in the image forming system according to the second embodiment, two reverse paths (the first reverse path 508 and the second reverse path 513) are laid in the image inspection device 500. Then, while a printed material is being reversed using the two reverse paths, it is determined whether or not there are defects in the images read from the printed material. If the determination result indicates that the printed material is a defective printed material, it is discharged to the discharge tray disposed in the image inspection device 500. On the other hand, if the determination result indicates that the printed material is a normal printed material; it is conveyed to the post-processing device 600 and, after being subjected to post-processing if necessary, is discharged to the discharge tray disposed in the post-processing device 600. Thus, while the printed material is being reversed using the two reverse paths, it is determined whether or not there are defects in the images printed on the printed material. With that, it becomes possible to convey the printed material to a predetermined conveying destination. As a result, it becomes possible to accurately separate the discharge destination for normal printed materials from the discharge destination for defective printed materials while maintaining the productivity of printed materials as well as without having to terminate the operations of the devices.

Third Embodiment

In the second embodiment, the image inspection device has two reverse paths used for reversing a printed material. The defect determination process with respect to a printed material is performed while that printed material is being reversed in the two reverse paths. If the determination result indicates that the printed material is a defective printed material, then that defective printed material is discharged to a discharge tray disposed in the image inspection device. In contrast, in a third embodiment, the post-processing device also includes a discharge tray for discharging defective printed materials. Thus, if the determination result indicates that the printed material is a defective printed material, then it is possible to select whether that defective printed material is to be discharged to the discharge tray disposed in the image inspection device or to the discharge tray disposed in the post-processing device.

Figure 10:
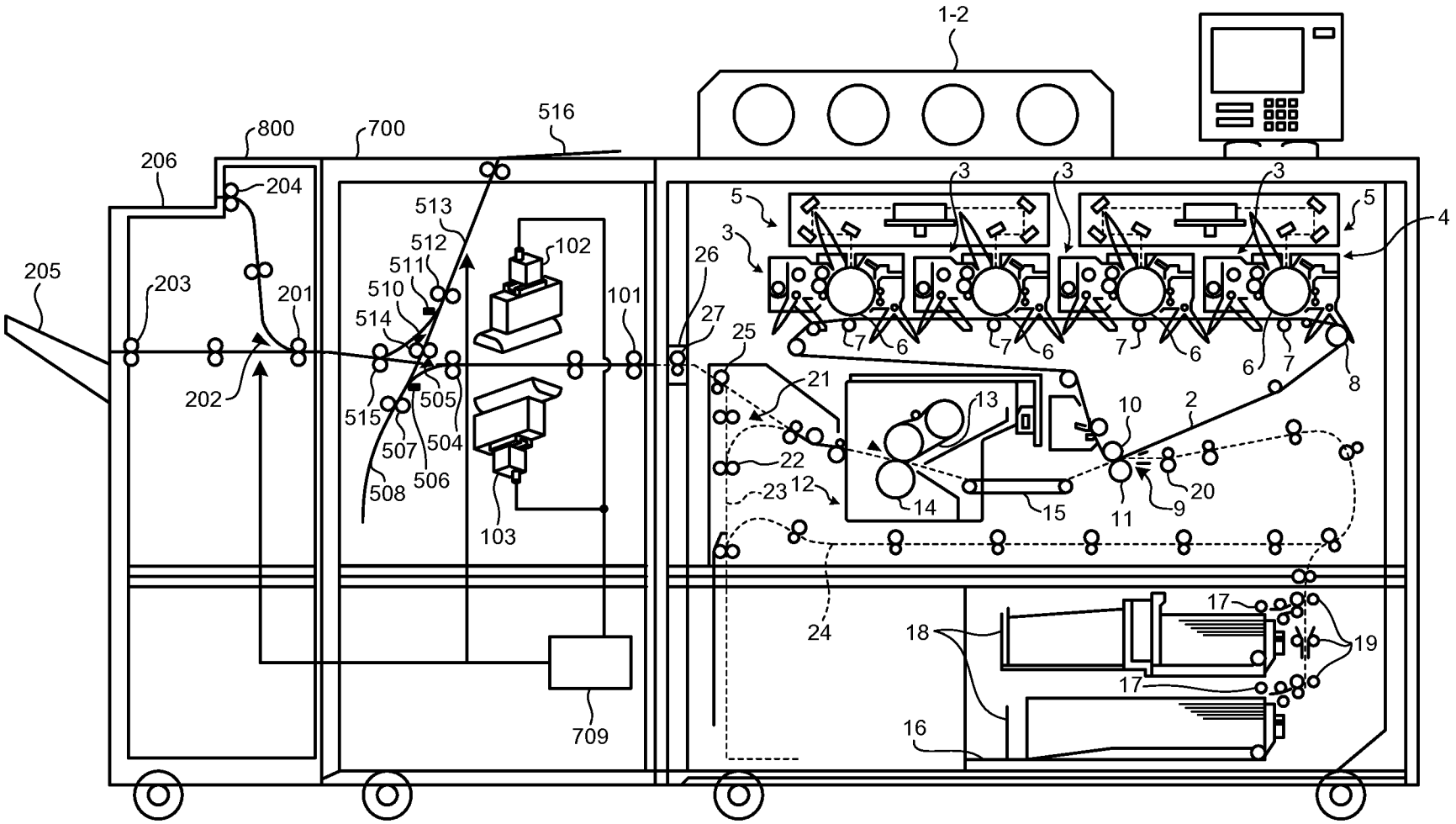
FIG. 10 is a configuration diagram illustrating an example of an image forming system according to a third embodiment.

Firstly, the explanation is given regarding an image forming system according to the third embodiment. FIG. 10 is a configuration diagram illustrating an example of the image forming system according to the third embodiment. Herein, the image forming system illustrated in FIG. 10 includes the image forming apparatus 1-2; an image inspection device 700 that is connected to the image forming apparatus 1-2; and a post-processing device 800 (a discharge device) that is connected to the image inspection device 700.

In the second embodiment described below, the configuration is such that, to the image inspection device 700, the post-processing device 800 is connected as the device which includes a discharge destination for normal printed materials as well as a discharge destination for defective printed materials. However, any other device which includes a discharge destination for normal printed materials as well as a discharge destination for defective printed materials can be connected to the image inspection device 700. Meanwhile, the image forming apparatus 1-2 according to the third embodiment can be applied to a multifunction peripheral or to an image forming apparatus such as a copying machine or a printer that outputs (prints) image data. Explained below with reference to FIG. 10 is a configuration and operations of the image forming system.

The constituent elements of the image forming apparatus 1-2 illustrated in FIG. 10 have configurations and relations of connection identical to the image forming apparatus 1 illustrated in FIG. 1. Moreover, the constituent elements of the image forming apparatus 1-2 illustrated in FIG. 10 function in the same manner as in the image forming apparatus 1 illustrated in FIG. 1. Thus, in the image forming apparatus 1-2 illustrated in FIG. 10, a composite color image is recorded on the recording member and the de-curler roller 27 conveys the recording member to the image inspection device 700. Therefore, the detailed explanation of the image forming apparatus 1-2 is not repeated.

Given below is the explanation regarding the image inspection device 700. Herein, in the image inspection device 700, the inlet roller 101 conveys a printed material to the reading units 102 and 103. Then, each of the reading units 102 and 103 reads the composite color image recorded on one of the sides of the printed material. Herein, in an identical manner to the configuration illustrated in FIG. 1, the reading unit 102 is positioned above the printed material being conveyed and reads the image recorded on the upper surface of the printed material; the reading unit 103 is positioned below the printed material being conveyed and reads the image recorded on the lower surface of the printed material.

Then, a defect determining unit 709 determines whether or not there are defects in the composite color images which have been read. That is, the defect determining unit 709 determines whether the composite color images point to a normal printed material not having any defects or to a defective printed material having defects.

The carriage roller 504 conveys the printed material by the branching claw 505 and the running sensor 506. Then, the flip roller 507 is made to perform positive rotation so that the printed material is conveyed to the first reverse path 508 and stops thereat. Herein, regarding the positive rotation of the flip roller 507 and regarding the first reverse path 508, the same explanation given in the second embodiment is applicable.

After waiting for a period of time required by the flip roller 507 to be able to perform reverse rotation, the flip roller 507 is reverse-rotated so that the print material again passes by the branching claw 505 and is conveyed to the carriage roller 514. Then, the carriage roller 514 conveys the printed material by the branching claw 510 and the running sensor 511. Subsequently, the flip roller 512 is made to perform positive rotation so that the printed material is conveyed to the second reverse path 513 and stops thereat. Herein, regarding the positive rotation of the flip roller 512 and regarding the second reverse path 513, the same explanation given in the second embodiment is applicable.

If the determination result of the defect determining unit 709 indicates that there is no defect in the images which have been read, then the printed material is discharged to the normal printed material discharge tray 205 that is disposed in the post-processing device 800. In this case, the branching claw 510 and the flip roller 512 are reverse-rotated so that the outlet roller 515 conveys the printed material to the post-processing device 800.

On the other hand, if the determination result of the defect determining unit 709 indicates that there are defects in the images which have been read, then the printed material is discharged to a discharge destination for defective printed materials according to an instruction from a controller (not illustrated). More particularly, in the case when the image inspection device 700 serves as the discharge destination for defective printed materials, the flip roller 512 is made to perform positive rotation so that the printed material is conveyed to the defective printed material discharge tray 516 that is connected to the second reverse path 513. On the other hand, in the case when the post-processing device 800 serves as the discharge destination for defective printed materials, the branching claw 510 and the flip roller 512 are reverse-rotated so that the outlet roller 515 conveys the printed material to the post-processing device 800.

Given below is the explanation regarding the post-processing device 800. In the post-processing device 800, depending on the determination result of the defect determining unit 709, it is selected whether to discharge the printed material that has been conveyed to the normal printed material discharge tray 205 or to the defective printed material discharge tray 206; and then the printed material is conveyed to the selected discharge destination using the branching claw 202.

More particularly, in the post-processing device 800, if the determination result of the defect determining unit 709 indicates that there is no defect in the images which have been read; then the inlet roller 201, the branching claw 202, and the discharge roller 203 discharge the printed material to the normal printed material discharge tray 205. On the other hand, in the post-processing device 800, if the determination result of the defect determining unit 709 indicates that there are defects in the images which have been read; then the inlet roller 201, the branching claw 202, and the discharge roller 204 discharge the printed material to the defective printed material discharge tray 206.

Figure 11:
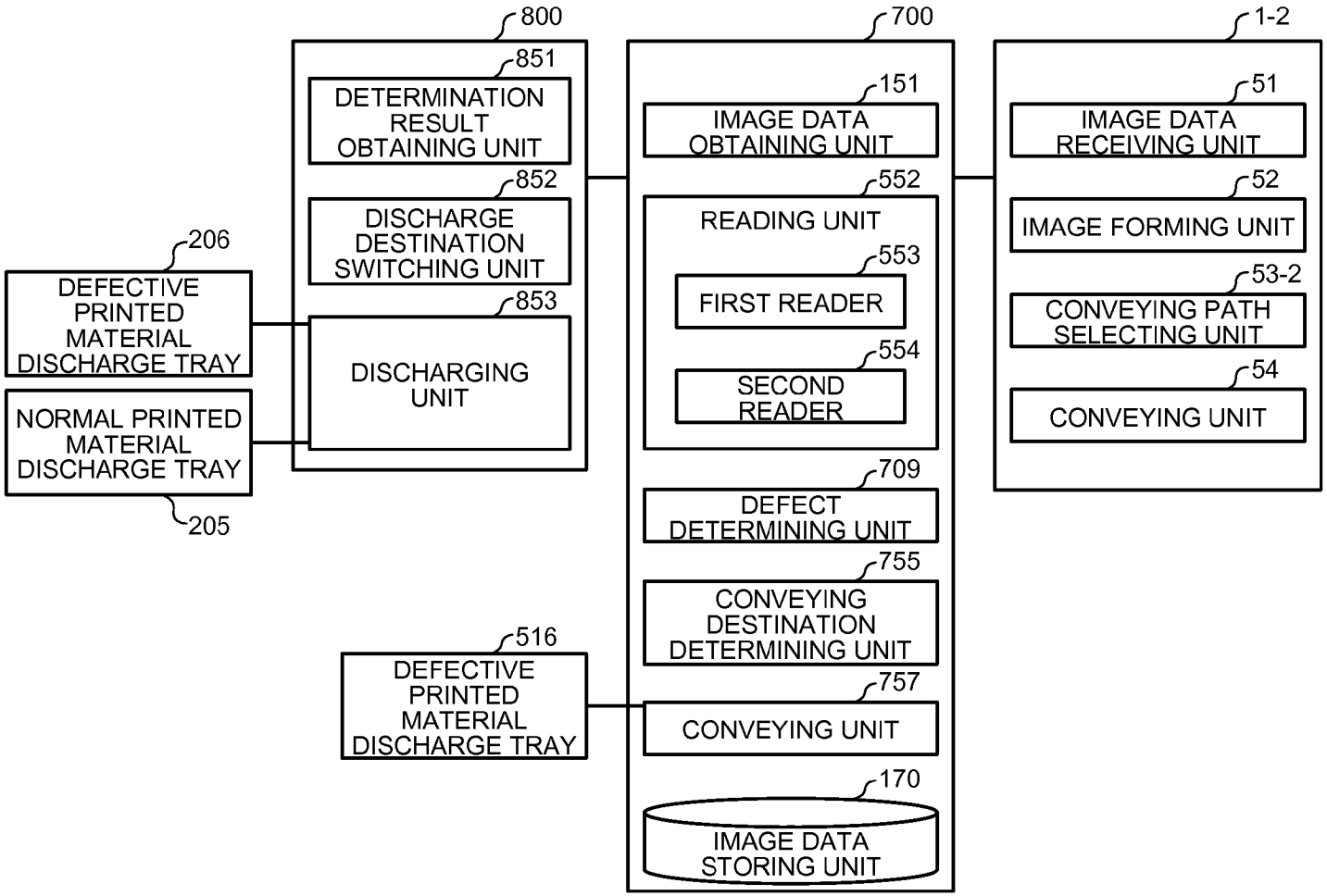
FIG. 11 is a block diagram illustrating a functional configuration of the image forming system illustrated in FIG. 10.

Given below is the explanation regarding a configuration of the image forming system illustrated in FIG. 10. FIG. 11 is a block diagram illustrating an example of the functional configuration of the image forming system illustrated in FIG. 10. As illustrated in FIG. 11, the image forming system illustrated in FIG. 10 includes the image forming apparatus 1-2, the image inspection device 700, and the post-processing device 800.

The image forming apparatus 1-2 includes the image data receiving unit 51, the image forming unit 52, the conveying path selecting unit 53-2, and the conveying unit 54. Herein, the image data receiving unit 51 and the image forming unit 52 have the same configurations and functions as described with reference to FIG. 3 according to the first embodiment. Hence, that explanation is not repeated. Moreover, the conveying path selecting unit 53-2 and the conveying unit 54 have the same configurations and functions as described with reference to FIG. 8 according to the second embodiment. Hence, that explanation is not repeated.

The image inspection device 700 includes the defective printed material discharge tray 516, the image data storing unit 170, the image data obtaining unit 151, the reading unit 552, the defect determining unit 709, a conveying destination determining unit 755, and a conveying unit 757. Herein, the image data storing unit 170 and the image data obtaining unit 151 have the same configurations and functions as described with reference to FIG. 3 according to the first embodiment. Hence, that explanation is not repeated. Moreover, the defective printed material discharge tray 516 and the reading unit 552 have the same configurations and functions as described with reference to FIG. 8 according to the second embodiment. Hence, that explanation is not repeated.

While a printed material, from which the images have been read by the reading unit 552, is present in the second reverse path 513; the defect determining unit 709 determines whether or not there are defects in the images which have been read by the reading unit 552. The determination of presence or absence of the defects is, for example, identical to that described in the first embodiment. Then, if it is determined that there are defects in the images which have been read and that the conveying destination determining unit 755 (described later) discharges the defective printed material using the post-processing device 800, then the defect determining unit 709 sends the determination result to the post-processing device 800.

If the determination result of the defect determining unit 709 indicates that there are defects in the images which have been read; then the conveying destination determining unit 755 determines the conveying destination for printed materials (the defective printed materials). More particularly, the conveying destination determining unit 755 determines whether to set the conveying destination for defective printed materials either to the defective printed material discharge tray 516 that is disposed in the image inspection device 700 or to the defective printed material discharge tray 206 that is disposed in the post-processing device 800. That determination can be performed, for example, in the following manner: at the time of performing image formation (printing), a selection input can be received from the user as an indication of the discharge tray to be considered as the discharge destination for defective printed materials, and that selection input can be followed when a printed material is determined to be a defective printed material. Alternatively, for example, that determination can be performed by setting in advance the discharge tray to be considered as the discharge destination for defective printed materials, and that setting can be followed when a printed material is determined to be a defective printed material.

The conveying unit 757 conveys the printed material that has been conveyed from the image forming apparatus 1-2. Moreover, based on the result of determination performed by the defect determining unit 709 to determine the presence or absence of defects in the images that have been read; the conveying unit 757 conveys the printed material, from which the images have been read by the reading unit 552, to the conveying destination.

More particularly, in the case when the defect determining unit 709 determines that there are defects in the images which have been read and when the conveying destination determining unit 755 determines the defective printed material discharge tray 516 to be the conveying destination; the conveying unit 757 conveys and discharges the printed material (the defective printed material) to the defective printed material discharge tray 516 that is connected to the second reverse path 513. Alternatively, in the case when the defect determining unit 709 determines that there are defects in the images which have been read and when the conveying destination determining unit 755 determines the defective printed material discharge tray 206 in the post-processing device 800 as the conveying destination; the conveying unit 757 conveys the printed material (the defective printed material) to the post-processing device 800. Meanwhile, if the defect determining unit 709 determines that there is not defect in the images which have been read, the corresponding printed material is a normal printed material. Hence, the conveying unit 757 conveys the printed material (the normal printed material) to the post-processing device 800. Consequently, the normal printed material is discharged to the normal printed material discharge tray 205.

Meanwhile, in the image inspection device 700, the time taken by the conveying unit 757 to reverse the printed material using the first reverse path 508 and the second reverse path 513 is longer than the time taken by the defect determining unit 709 to determine the presence or absence of defects in the images which have been read.

The post-processing device 800 includes the normal printed material discharge tray 205, the defective printed material discharge tray 206, a determination result obtaining unit 851, a discharge destination switching unit 852, and a discharging unit 853.

The normal printed material discharge tray 205 is the tray to which is discharged a normal printed material that is conveyed from the image inspection device 700 and that has non-defective images printed thereon. The defective printed material discharge tray 206 is the tray to which is discharged a defective printed material that has defective images printed thereon.

The determination result obtaining unit 851 obtains the determination result that is sent by the defect determining unit 709 in the image inspection device 700. If it is determined in the image inspection device 700 that there are defects in the images which have been read and if the conveying destination determining unit 755 determines that the defective printed material is to be discharged using the post-processing device 800, then the determination result sent from the defect determining unit 709 is obtained by the determination result obtaining unit 851.

Once the determination result obtaining unit 851 obtains the determination result; the discharge destination switching unit 852 switches the discharge destination according to that determination result. More particularly, when the determination result indicates that there are defects in the images which have been read, the discharge destination switching unit 852 switches the branching claw 202 so that the printed material is discharged to the defective printed material discharge tray 206. On the other hand, when the determination result indicates that there is no defect in the images which have been read, the discharge destination switching unit 852 switches the branching claw 202 so that the printed material is discharged to the normal printed material discharge tray 205.

The discharging unit 853 conveys and discharges the printed material, which has been conveyed from the image inspection device 700, to the discharge destination set by the discharge destination switching unit 852. More particularly, if it is determined that there are defects in the images which have been read in the image inspection device 700, then the printed material (the defective printed material) is discharged to the defective printed material discharge tray 206. On the other hand, if it is determined that there is no defect in the images which have been read in the image inspection device 700, then the printed material (the normal printed material) is discharged to the normal printed material discharge tray 205.

Figure 12A:
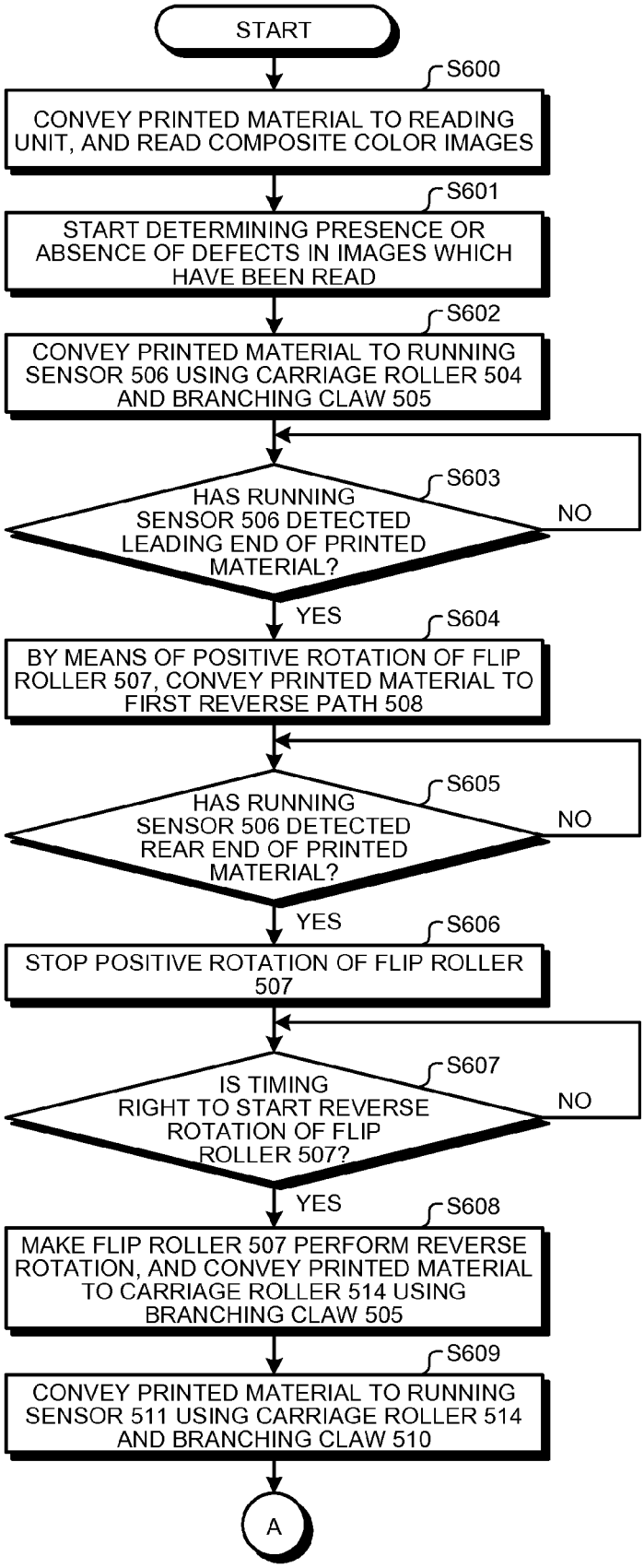
FIGS. 12A and 12B illustrate a flowchart of a printed material conveying operation performed in the image forming system according to the third embodiment.
Figure 12B:
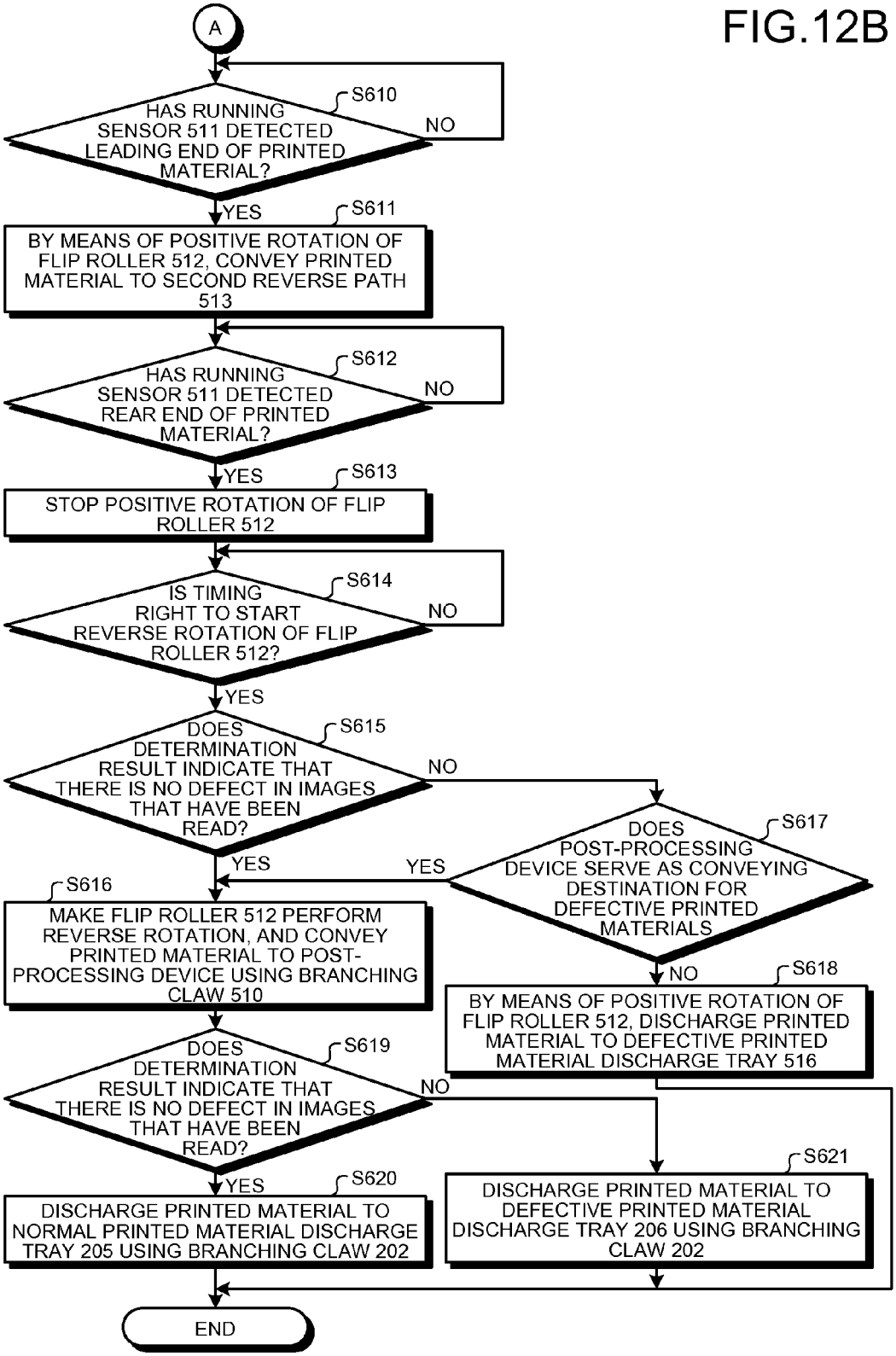

Given below is the explanation regarding a printed material conveying operation performed in the image forming system according to the third embodiment. FIGS. 12A and 12B are flowcharts for explaining the printed material conveying operation performed in the image forming system according to the third embodiment. Herein, the operations starting from reading composite color images by the reading units 102 and 103 to determining the right timing to perform reverse-rotation of the flip roller 512 by the conveying unit 757 (i.e., operations from Step S600 to Step S614) are identical to the operations from Step S500 to Step S514 described with reference to FIGS. 9A and 9B. Hence, that explanation is not repeated.

Then, the conveying unit 757 determines whether or not the determination result of the defect determining unit 709 indicates that there is no defect in the images which have been read (Step S615). If the determination result indicates that there is no defect in the images, that is, if the printed material is a normal printed material (Yes at Step S615); then the conveying unit 757 makes the flip roller 507 perform reverse rotation and moves the branching claw 510 in the direction in which the printed material is to be conveyed toward the post-processing device 800, so that the printed material is conveyed to the post-processing device (Step S616).

On the other hand, if the determination result indicates that there are defects in the images, that is, if the printed material is a defective printed material (No at Step S615); then the conveying destination determining unit 755 determines whether or not the post-processing device 800 is the conveying destination for defective printed materials (Step S617). If the post-processing device 800 is the conveying destination for defective printed materials (Yes at Step S617), then the system control proceeds to Step S616 and the printed material is conveyed to the post-processing device 800.

On the other hand, if the post-processing device 800 is not the conveying destination for defective printed materials, that is, if the defective printed material discharge tray 516 of the image inspection device 700 is the conveying destination for defective printed materials (No at Step S617); then the conveying unit 757 makes the flip roller 512 perform positive rotation so that the printed material (the defective printed material) is discharged to the defective printed material discharge tray 516 (Step S618).

Subsequent to Step S616, the discharge destination switching unit 852 of the post-processing device 800 determines whether or not the determination result obtained by the determination result obtaining unit 851 indicates that there is no defect in the images which have been read (Step S619). If the determination result indicates that there is no defect in the images, that is, if the printed material is a normal printed material (Yes at Step S619); then the discharge destination switching unit 852 switches the branching claw 202 so that the printed material is discharged to the normal printed material discharge tray 205, and the discharging unit 853 discharges the printed material to the normal printed material discharge tray 205 that is the conveying destination set by the branching claw 202 (Step S620).

On the other hand, if the determination result indicates that there are defects in the images, that is, if the printed material is a defective printed material (No at Step S619); then the discharge destination switching unit 852 switches the branching claw 202 so that the printed material is discharged to the defective printed material discharge tray 206, and the discharging unit 853 discharges the printed material to the defective printed material discharge tray 206 that is the conveying destination set by the branching claw 202 (Step S621).

In this way, in the image forming system according to the third embodiment, two reverse paths (the first reverse path 508 and the second reverse path 513) are laid in the image inspection device 700. Then, while a printed material is being reversed using the two reverse paths, it is determined whether or not there are defects in the images read from the printed material. If the determination result indicates that the printed material is a defective printed material and if that printed material is to be discharged using the image inspection device 700, then the printed material is discharged to the discharge tray disposed in the image inspection device 700. Alternatively, if the determination result indicates that the printed material is a defective printed material and if that printed material is to be discharged using the post-processing device 800, then the printed material is conveyed to the post-processing device 800 and is discharged to the defective printed material discharge tray disposed in the post-processing device 800. On the other hand, if the determination result indicates that the printed material is a normal printed material; then the printed material is conveyed to the post-processing device 800 and, after being subjected to post-processing if necessary, is discharged to the normal printed material discharge tray disposed in the post-processing device 600. Thus, while the printed material is being reversed using the two reverse paths, it is determined whether or not there are defects in the images printed on the printed material. With that, it becomes possible to convey the printed material to a predetermined conveying destination. As a result, it becomes possible to accurately separate the discharge destination for normal printed materials from the discharge destination for defective printed materials while maintaining the productivity of printed materials as well as without having to terminate the operations of the devices.

Fourth Embodiment

In the first embodiment, depending on whether a post-processing device (a discharge device) is connected directly to the image inspection device or whether the post-processing device is connected to the image inspection device via a paper cooling device (another device); either a normal conveying path is selected for conveying the printed material as it is or an inversion conveying path is selected for conveying the printed material after being reversed. In contrast, in a fourth embodiment, depending on whether a post-processing device (a discharge device) is connected directly to the image inspection device or whether the post-processing device is connected to the image inspection device via a paper cooling device (another device); either a conveying path is selected for conveying a printed material as it is or a conveying path is selected for conveying the printed material upon being cooled.

Figure 13:
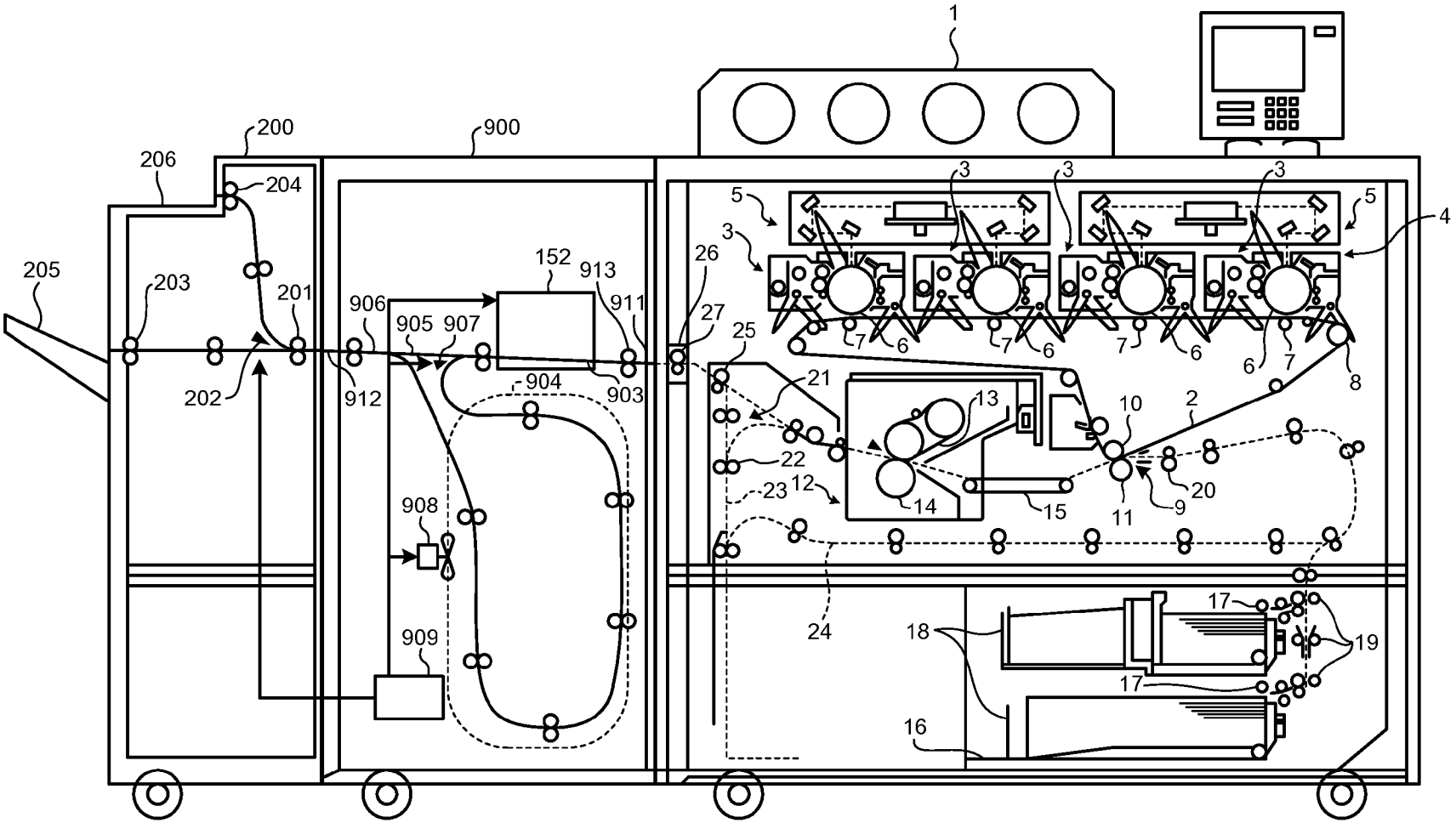
FIG. 13 is a configuration diagram illustrating an example of an image forming system according to a fourth embodiment.

Firstly, the explanation is given regarding an image forming system according to the fourth embodiment. FIG. 13 is a configuration diagram illustrating an example of the image forming system according to the fourth embodiment. Herein, the image forming system illustrated in FIG. 13 includes the image forming apparatus 1; an image inspection device 900 that is connected to the image forming apparatus 1; and the post-processing device 200 (a discharge device) that is connected to the image inspection device 900.

In the fourth embodiment described below, the configuration is such that, to the image inspection device 900, the post-processing device 200 is connected as the device which includes a discharge destination for normal printed materials. However, any other device which includes a discharge destination for normal printed materials can be connected to the image inspection device 900. Meanwhile, the image forming apparatus 1 according to the second embodiment can be applied to a multifunction peripheral or to an image forming apparatus such as a copying machine or a printer that outputs (prints) image data. Explained below with reference to FIG. 13 is a configuration and operations of the image forming system.

The constituent elements of the image forming apparatus 1 illustrated in FIG. 13 have configurations and relations of connection identical to the image forming apparatus 1 illustrated in FIG. 1. Moreover, the constituent elements of the image forming apparatus 1-2 illustrated in FIG. 13 function in the same manner as in the image forming apparatus 1 illustrated in FIG. 1. Thus, in the image forming apparatus 1 illustrated in FIG. 13, a composite color image is recorded on the recording member and the de-curler roller 27 conveys the recording member to the image inspection device 900. Therefore, the detailed explanation of the image forming apparatus 1 is not repeated.

Given below is the explanation regarding the image inspection device 900. Herein, in the image inspection device 900, while a printed material (i.e., a recording member having images printed thereon) that is conveyed from the image forming apparatus 1 is being conveyed along a conveying path; the reading unit 152 reads the images from the printed material. Then, it is determined whether or not there are defects in the images that have been read. Depending on the determination result regarding defects (i.e., depending on whether the printed material is a normal printed material or a defective printed material), the discharge destination for printed materials in the post-processing device 200 is switched. The reading unit 152 includes, for example, the reading units 102 and 103 for reading images as illustrated in FIG. 1.

As illustrated in FIG. 13, in the image inspection device 900, the conveying paths for conveying printed materials include a first conveying path 903; a cooling conveying path 904 and a second conveying path 905 that are connected in a branching manner at the downstream side of the printed material conveying direction in the first conveying path 903; and a third conveying path 906 that is formed when the cooling conveying path 904 and the second conveying path 905 converge again at the downstream side of the printed material conveying direction.

At the upstream side of the printed material conveying direction in the first conveying path 903; a conveying inlet 911 is formed for conveying the printed material to the image inspection device 900. The conveying inlet 911 connects the image inspection device 900 to a conveying path in the image forming apparatus 1. At the downstream side of the printed material conveying direction in the third conveying path 906; a discharge roller 912 is disposed for discharging the printed material from the image inspection device 900. The discharge roller 912 connects the image inspection device 900 to a conveying path in the post-processing device 200.

At the branching position of the second conveying path 905 and the cooling conveying path 904 is disposed a branching claw 907 that, under the control of a control unit 909, rotates around a driving shaft which receives a driving force from a motor (not illustrated). As a result, the printed material that is passing over the branching position of the second conveying path 905 and the cooling conveying path 904 is guided to either one of the second conveying path 905 and the cooling conveying path 904.

In the conveying paths laid in the image inspection device 900, a plurality of carriage rollers represented by a carriage roller 913 is appropriately disposed. Under the control of the control unit 909, those rollers rotate by receiving a driving force from a motor (not illustrated) and convey the printed material.

The cooling conveying path 904 is configured with a metal guide plate (not illustrated) in a cooled state. The cooling conveying path 904 conveys the printed material while cooling it with the air that is produced by a cooling fan 908 under the control of the control unit 909.

The printed material that is discharged from the image forming apparatus 1 reaches the first conveying path 903 via the conveying inlet 911 of the image inspection device 900, and is then conveyed forward by the carriage rollers. While passing through the first conveying path 903; when the printed material passes by the position at which the reading unit 152 is disposed, the images printed thereon are read by the reading unit 152.

The images read from the printed material by the reading unit 152 are sent to the control unit 909. Then, in the control unit 909, the defect determining unit 109 (see FIG. 15) determines whether or not there are defects in the images which have been read.

Subsequently, in the image forming system illustrated in FIG. 13, at the downstream side of the printed material conveying direction in the image inspection device 900, the post-processing device 200 is directly connected without using another device (such as a paper cooling device) in between. In this case, the printed material is conveyed using the cooling conveying path 904, so that the printed material which has been cooled is conveyed to the post-processing device 200.

The printed material passing through the cooling conveying path 904 gets cooled by coming in contact with the above-mentioned metal guide plate (not illustrated) in a cooled state. Meanwhile, as far as cooling the printed material is concerned, one method is to cool the metal guide plate with the air produced by the cooling fan 908 and then to cool the printed material using the cold metal guide plate, while the other method is to cool the printed material by directly exposing it to the air produced by the cooling fan 908.

The constituent elements of the post-processing device 200 illustrated in FIG. 13 have configurations and relations of connection identical to the post-processing device 200 illustrated in FIG. 1. Moreover, the constituent elements of the post-processing device 200 illustrated in FIG. 13 function in the same manner as in the post-processing device 200 illustrated in FIG. 1. Thus, in the case of discharging a printed material as a normal printed material; the inlet roller 201, the branching claw 202, and the discharge roller 203 discharge that printed material to the normal printed material discharge tray 205. On the other hand, in the case of discharging a printed material as a defective printed material; the inlet roller 201, the branching claw 202, and the discharge roller 204 discharge that printed material to the defective printed material discharge tray 206.

Figure 14:
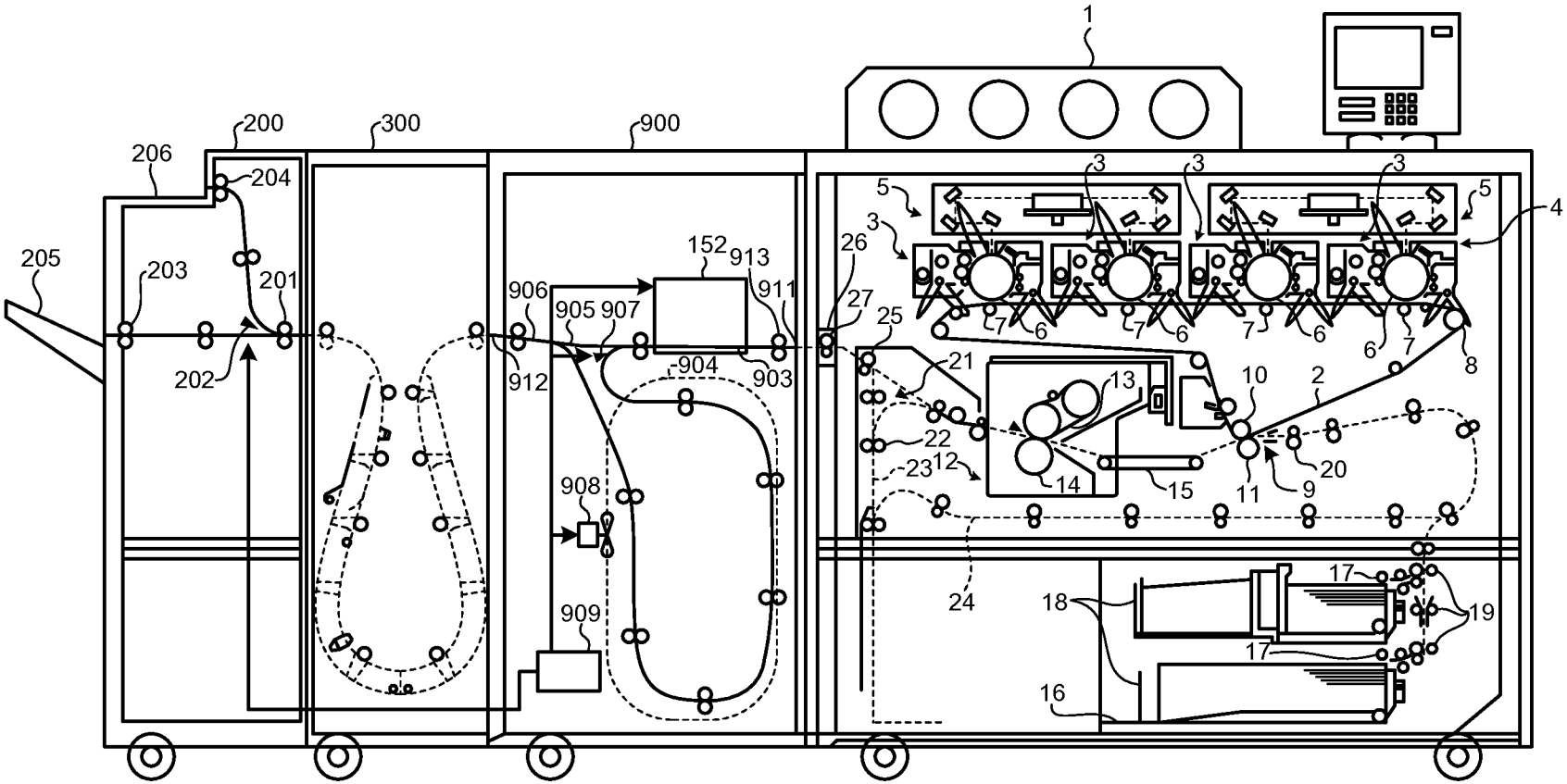
FIG. 14 is a configuration diagram illustrating another example of the image forming system according to the fourth embodiment.

Given below is the explanation regarding another example of the image forming system according to the fourth embodiment. FIG. 14 is a configuration diagram illustrating another example of the image forming system according to the fourth embodiment. In FIG. 13, the post-processing device 200 is directly connected to the image inspection device 900 at the downstream side of the printed material conveying direction in the image inspection device 900. FIG. 14 illustrates a configuration example for a case in which the post-processing device 200 is connected to the image inspection device 900 at the downstream side of the printed material conveying direction in the image inspection device 900 via the paper cooling device 300. The image forming system illustrated in FIG. 14 includes the image forming apparatus 1; the image inspection device 900 that is connected to the image forming apparatus 1; the paper cooling device 300 (a device which does not include a discharge destination for defective printed materials) that is connected to the image forming apparatus 1; and the post-processing device 200 (a discharge device: a device which includes a discharge destination for defective printed materials) that is connected to the paper cooling device 300.

In the fourth embodiment described below, the configuration is such that, to the image inspection device 900, a paper cooling device is connected as the device which does not include a discharge destination for defective printed materials. However, any other device which does not include a discharge destination for defective printed materials can be connected to the image inspection device 900. Explained below with reference to FIG. 14 is a configuration and operations of the image forming system.

The constituent elements of the image forming apparatus 1 illustrated in FIG. 14 have configurations and relations of connection identical to the image forming apparatus 1 illustrated in FIG. 1. Moreover, the constituent elements of the image forming apparatus 1 illustrated in FIG. 14 function in the same manner as in the image forming apparatus 1 illustrated in FIG. 1. Thus, in the image forming apparatus 1 illustrated in FIG. 14, a composite color image is recorded on the recording member and the de-curler roller 27 conveys the recording member to the image inspection device 900. Therefore, the detailed explanation of the image forming apparatus 1 is not repeated.

Given below is the explanation regarding the image inspection device 900. The constituent elements of the image inspection device 900 illustrated in FIG. 14 have configurations and relations of connection identical to the image inspection device 900 illustrated in FIG. 13. Moreover, the constituent elements of the image inspection device 900 illustrated in FIG. 14 function in the same manner as in the image inspection device 900 illustrated in FIG. 13.

That is, the printed material discharged from the image forming apparatus 1 reaches the first conveying path 903 via the conveying inlet 911 of the image inspection device 900, and is then conveyed forward by the carriage rollers. While passing through the first conveying path 903; when the printed material passes by the position of the reading unit 152, the images printed thereon are read by the reading unit 152. Then, the images read from the printed material by the reading unit 152 are sent to the control unit 909. Then, in the control unit 909, the defect determining unit 109 (see FIG. 16) determines whether or not there are defects in the images which have been read.

Subsequently, in the image forming system illustrated in FIG. 14, the post-processing device 200 is connected to the image inspection device 900 at the downstream side of the printed material conveying direction in the image inspection device 900 via the paper cooling device 300 that does not include a discharge destination for defective printed materials. In this case, after the printed material is conveyed using the second conveying path 905, it gets conveyed to the paper cooling device 300.

The constituent elements of the paper cooling device 300 illustrated in FIG. 14 have configurations and relations of connection identical to the paper cooling device 300 illustrated in FIG. 1. Moreover, the constituent elements of the paper cooling device 300 illustrated in FIG. 14 function in the same manner as in the paper cooling device 300 illustrated in FIG. 1. Hence, that explanation is not repeated.

Similarly, the constituent elements of the post-processing device 200 illustrated in FIG. 14 have configurations and relations of connection identical to the post-processing device 200 illustrated in FIG. 1. Moreover, the constituent elements of the post-processing device 200 illustrated in FIG. 14 function in the same manner as in the post-processing device 200 illustrated in FIG. 1. Hence, that explanation is not repeated.

Figure 15:
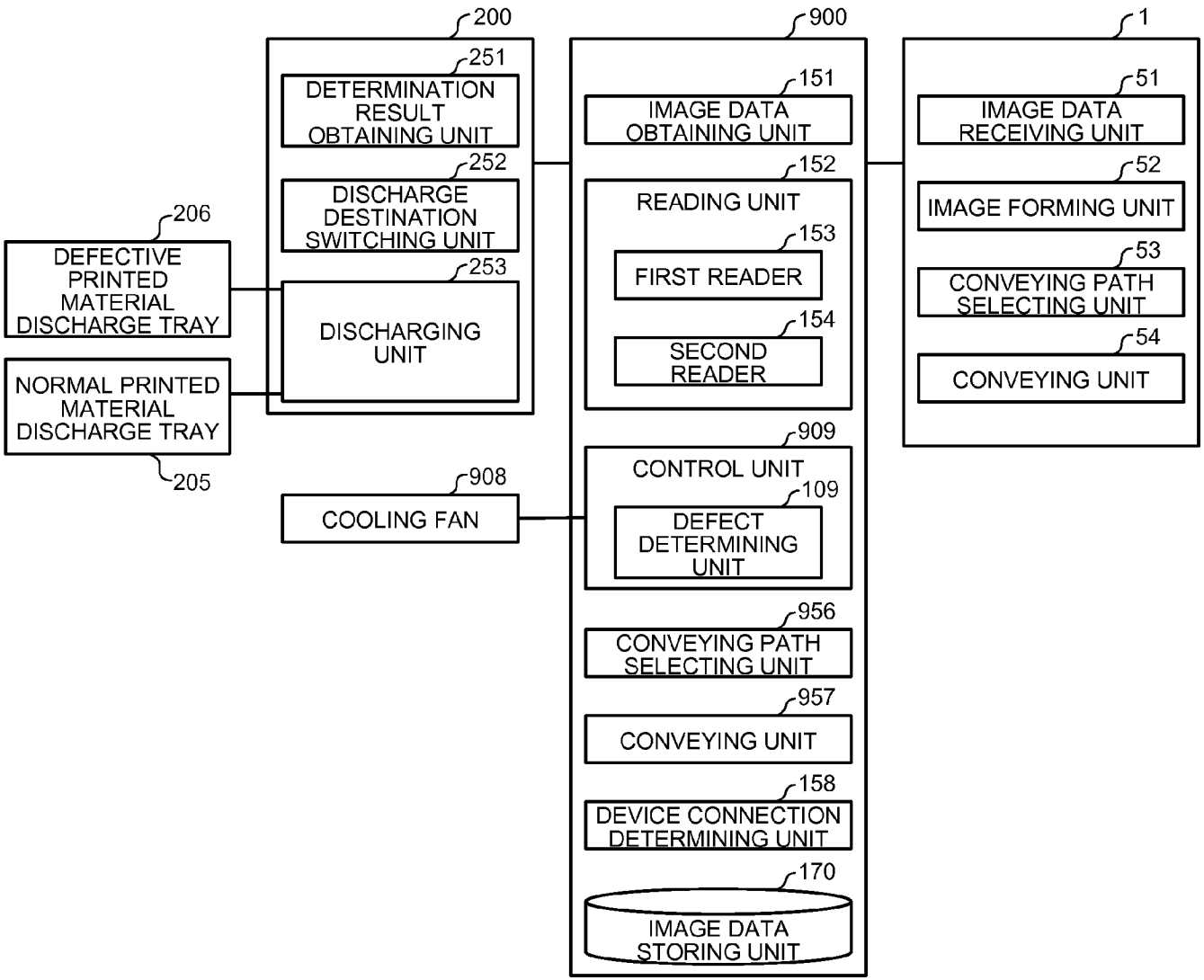
FIG. 15 is a block diagram illustrating a functional configuration of the image forming system illustrated in FIG. 13.

Given below is the explanation regarding a configuration of the image forming system illustrated in FIG. 13. FIG. 15 is a block diagram illustrating an example of the functional configuration of the image forming system illustrated in FIG. 13. As illustrated in FIG. 15, the image forming system illustrated in FIG. 13 includes the image forming apparatus 1, the image inspection device 900, and the post-processing device 200. Herein, the image forming apparatus 1 and the post-processing device 200 have the same configurations and functions as in the image forming system according to the first embodiment (see FIG. 3). Hence, that explanation is not repeated.

The image inspection device 900 includes the image data storing unit 170, the image data obtaining unit 151, the reading unit 152, the control unit 909, a conveying path selecting unit 956, a conveying unit 957, and the device connection determining unit 158. Herein, the image data storing unit 170, the image data obtaining unit 151, the reading unit 152, and the device connection determining unit 158 have the same configurations and functions as described with reference to FIG. 3. Hence, that explanation is not repeated.

The control unit 909 controls the driving of a motor (not illustrated) so that the printed material passing over the branching position of the second conveying path 905 and the cooling conveying path 904 is guided to either one of the second conveying path 905 and the cooling conveying path 904. Moreover, the control unit 909 controls the driving of a motor (not illustrated) so that the printed material is conveyed via the conveying unit 957. Furthermore, the control unit 909 controls the driving of a motor (not illustrated) so that the cooling fan 908 rotates and produces air.

The control unit 909 includes the defect determining unit 109. In an identical manner to the first embodiment, the defect determining unit 109 determines whether or not there are defects in images which have been read by the reading unit 152, and sends the determination result to the post-processing device 200.

Based on the determination result of the device connection determining unit 158; the conveying path selecting unit 956 selects, from among the conveying paths laid in the image inspection device 900, a conveying path for conveying the printed material from which the image data has been read by the reading unit 152. Herein, the conveying paths laid in the image inspection device 900 include, firstly, a conveying path (a shorter conveying path) in which the printed material is conveyed to the post-processing device 200 using the first conveying path 903, the second conveying path 905, and the third conveying path 906. Other than that, the conveying paths include a conveying path (a longer conveying path) in which the printed material is conveyed to the post-processing device 200 using the first conveying path 903, the cooling conveying path 904, and the third conveying path 906.

As illustrated in FIG. 15, when the post-processing device 200 is directly connected to the image inspection device 900 at the downstream side of the printed material conveying direction in the image inspection device 900 in the image forming system (see FIG. 13), the conveying path selecting unit 956 selects the longer conveying path in which the printed material is conveyed to the post-processing device 200 after being cooled in the cooling conveying path 904.

The conveying unit 957 sends the printed material, from which the image data has been read by the reading unit 152, to the post-processing device 200 using the conveying path, which is selected by the conveying path selecting unit 956 and in which the printed material passes through the cooling conveying path 904.

Meanwhile, when the post-processing device 200 is directly connected to the image inspection device 900 at the downstream side of the printed material conveying direction in the image inspection device 900, the time taken by the conveying unit 957 to convey the printed material using the conveying path in which the printed material passes through the cooling conveying path 904 is longer than the time taken by the defect determining unit 109 to determine the presence or absence of defects in the images which have been read.

Figure 16:
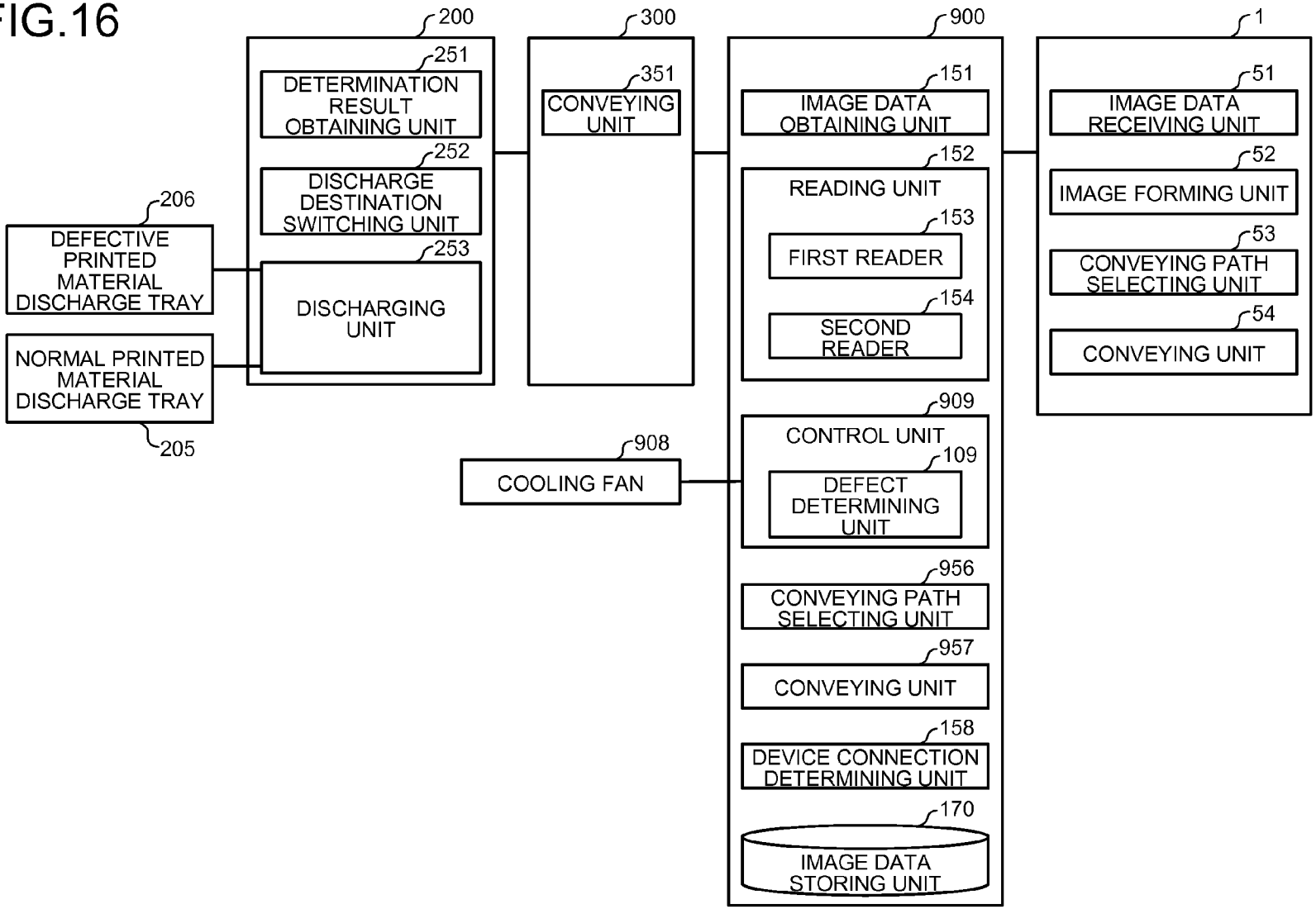
FIG. 16 is a block diagram illustrating a functional configuration of the image forming system illustrated in FIG. 14.

Given below is the explanation regarding a configuration of the image forming system illustrated in FIG. 14. FIG. 16 is a block diagram illustrating an example of the functional configuration of the image forming system illustrated in FIG. 14. As illustrated in FIG. 16, the image forming system illustrated in FIG. 16 includes the image forming apparatus 1, the image inspection device 900, the paper cooling device 300, and the post-processing device 200. Herein, the image forming apparatus 1, the paper cooling device 300, and the post-processing device 200 have the same configurations and functions as in the image forming system according to the first embodiment (see FIG. 4). Hence, that explanation is not repeated.

The image inspection device 900 includes the image data storing unit 170, the image data obtaining unit 151, the reading unit 152, the control unit 909, the conveying path selecting unit 956, the conveying unit 957, and the device connection determining unit 158. Herein, the image data storing unit 170, the image data obtaining unit 151, the reading unit 152, and the device connection determining unit 158 have the same configurations and functions as described with reference to FIG. 4. Hence, that explanation is not repeated. Moreover, the control unit 909 is identical to the control unit 909 described with reference to FIG. 15. Hence, that explanation is not repeated. Meanwhile, although the conveying path selecting unit 956 and the conveying unit 957 have the same configurations and functions as described with reference to FIG. 15, they perform operations in the manner explained below.

As illustrated in FIG. 16, when the post-processing device 200 is connected to the image inspection device 900 at the downstream side of the printed material conveying direction in the image inspection device 900 via the paper cooling device 300 in the image forming system (see FIG. 14), the conveying path selecting unit 956 selects the conveying path in which the printed material is conveyed to the post-processing device 200 using the first conveying path 903, the second conveying path 905, and the third conveying path 906.

The conveying unit 957 sends the printed material, from which the image data has been read by the reading unit 152, to the post-processing device 200 using the conveying path, which is selected by the conveying path selecting unit 956 and in which the printed material passes through the second conveying path 905.

Figure 17:
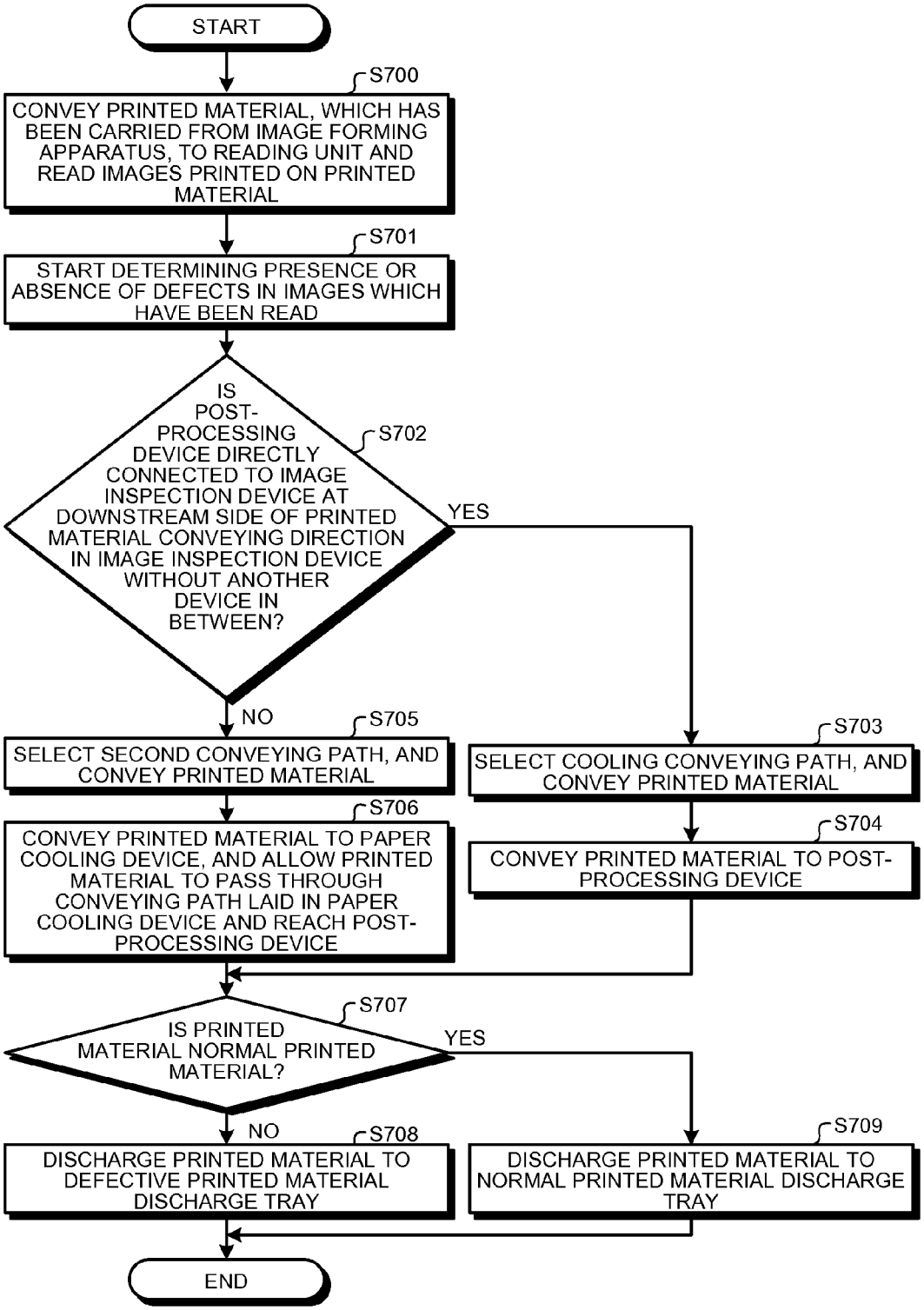
FIG. 17 illustrates a flowchart of a printed material conveying operation performed in the image forming system according to the fourth embodiment.

Given below is the explanation regarding a printed material conveying operation performed in the image forming system (illustrated in FIG. 13 or FIG. 14) according to the fourth embodiment. FIG. 17 is a flowchart for explaining the printed material conveying operation performed in the image forming system according to the fourth embodiment.

Firstly, the conveying unit 957 of the image inspection device 900 conveys the printed material, which has been conveyed from the image forming apparatus 1, to the reading unit 152; and the reading unit 152 reads the images which have been printed on the printed material (Step S700). Then, the defect determining unit 109 starts determining the absence or presence of defects in the images which have been read (Step S701).

Subsequently, the device connection determining unit 158 determines whether or not the post-processing device 200 is directly connected to the image inspection device 900 at the downstream side of the printed material conveying direction in the image inspection device 900 without using another device (such as the paper cooling device 300) in between (Step S702).

If the post-processing device 200 is directly connected without using another device in between, that is, if the image forming system has the configuration illustrated in FIG. 13 (Yes at Step S702); then the conveying path selecting unit 956 selects the cooling conveying path 904, and the conveying unit 957 conveys the printed material using the first conveying path 903, the cooling conveying path 904, and the third conveying path 906 (Step S703). Subsequently, the conveying unit 957 conveys the printed material to the post-processing device 200 (Step S704).

On the other hand, if the post-processing device 200 is connected using another device (the paper cooling device 300) in between, that is, if the image forming system has the configuration illustrated in FIG. 14 (No at Step S702); then the conveying path selecting unit 956 selects the second conveying path 905, and conveys the printed material using the first conveying path 903, the second conveying path 905, and the third conveying path 906 (Step S705). Then, the conveying unit 957 conveys the printed material to the paper cooling device 300; and the conveying unit 351 of the paper cooling device 300 allows the printed material to pass through a conveying path laid in the paper cooling device 300 and then reach the post-processing device 200 (Step S706).

Then, according to the determination result of the defect determining unit 109 of the image inspection device 900, the discharge destination switching unit 252 of the post-processing device 200 determines whether or not the printed material that has been conveyed is a normal printed material (Step S707), and accordingly switches the discharge destination for printed materials.

If the printed material is not a normal printed material, that is, if the printed material is a defective printed material (No at Step S707); then the discharging unit 253 discharges the printed material to the defective printed material discharge tray 206 (Step S708). On the other hand, if the printed material is a normal printed material (Yes at Step S707); then the discharging unit 253 discharges the printed material to the normal printed material discharge tray 205 (Step S709). That marks the end of the operations.

In this way, according to the fourth embodiment, in the image forming system in which a printed material is conveyed to the post-processing device 200 that is connected to the image inspection device 900 without using another device in between (FIG. 13); a conveying path including the cooling conveying path 904 is selected in the image inspection device 900, so that the printed material is conveyed to the post-processing device 200 after being cooled in the cooling conveying path 904. On the other hand, in the image forming system in which a printed material is conveyed to the post-processing device 200 that is connected to the image inspection device 900 via the paper cooling device 300 (FIG. 14); a conveying path including the second conveying path 905 is selected in the image inspection device 900, so that the images printed on the printed material are read and then the printed material is conveyed without being cooled to the paper cooling device 300 and the post-processing device 200.

Thus, in the image forming system illustrated in FIG. 13, the defect determining unit 109 can determine the presence or absence of defects in images while the printed material is being cooled and conveyed in the cooling conveying path 904; and the determination result can be used in ensuring that a discharge destination for normal printed materials and a discharge destination for defective printed materials are separately secured in the post-processing device 200. In the image forming system illustrated in FIG. 14, even if the printed material is conveyed to the paper cooling device 300 through the second conveying path 905; the defect determining unit 109 can determine the presence or absence of defects in images while the printed material is being conveyed through the paper cooling device 300, and the determination result can be used in ensuring that a discharge destination for normal printed materials and a discharge destination for defective printed materials are separately secured in the post-processing device 200. Hence, it becomes possible to convey the printed material in accordance with the configuration of any of the two types of the image forming system. As a result, it becomes possible to accurately separate the discharge destination for normal printed materials from the discharge destination for defective printed materials while maintaining the productivity of printed materials.

According to an aspect of the present invention, it is possible to accurately separate a discharge destination for normal printed materials from a discharge destination for defective printed materials while maintaining the productivity of printed materials.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system comprising:

an image forming apparatus comprising an image forming unit configured to output image data onto a recording medium;

an image inspection device connected to the image forming apparatus comprising a reading unit configured to read an image from the recording medium that is conveyed;

a discharge device connected to the image inspection device;

wherein the image inspection device further comprises a first conveying unit configured to convey the recording medium onto which the image data has been output;

wherein at least one of the image forming apparatus, the image inspection device, and the discharge device comprises a defect determining unit configured to determine whether the read image has a defect;

wherein the image inspection device further comprises a plurality of conveying paths arranged to convey the recording medium whose image has been read, the conveying paths having different lengths;

wherein at least one of the image forming apparatus, the image inspection device, and the discharge device comprises a device connection determining unit configured to determine whether, at a downstream side of the image inspection device in a direction in which the recording medium is conveyed, the discharge device is directly connected to the image inspection device without another device in between or is connected to the image inspection device via another device;

wherein the image inspection device further comprises a second conveying unit configured to convey the recording medium to the discharge device by using a longer conveying path from among the plurality of conveying paths, in response to the discharge device being directly connected to the image inspection device at the downstream side without another device in between;

wherein the discharge device further comprises:

a defective recording medium discharge tray unit to which the recording medium having a defective image output thereon is discharged; and a normal recording medium discharge tray unit to which the recording medium having a non-defective image output thereon is discharged; and wherein at least one of the image forming apparatus, the image inspection device, and the discharge device comprises a discharging unit configured to discharge the recording medium to the defective recording medium discharge tray unit, when the read image is determined to have a defect, and discharge the recording medium to the normal recording medium discharge tray unit, when the read image is determined to have no defect.

2. The image forming system according to claim 1, wherein, when the discharge device is connected to the image inspection device at the downstream side via another device, the second conveying unit conveys the recording medium to the discharge device by using a shorter conveying path from among the plurality of conveying paths.

3. The image forming system according to claim 1, wherein the longer conveying path includes a conveying path including a reverse path for reversing the recording medium, and when the discharge device is connected to the image inspection device at the downstream side without another device in between, the second conveying unit reverses the recording medium by using the conveying path including the reverse path and then conveys the reversed recording medium to the discharge device.

4. The image forming system according to claim 3, wherein, when the discharge device is connected to the image inspection device at the downstream side without another device in between, the time taken by the second conveying unit to reverse the recording medium by using the conveying path including the reverse path is longer than the time taken by the defect determining unit to determine whether the read image has a defect.

5. The image forming system according to claim 3, wherein the reading unit includes a first reader that reads, from one direction, the image formed on the recording medium that is being conveyed, and when the discharge device is connected to the image inspection device at the downstream side without another device in between and when single-sided printing is performed for outputting the image data onto a first side of the recording medium and the recording medium is to be discharged with the first side facing down, the first reader reads an image formed on the first side of the recording medium.

6. The image forming system according to claim 5, wherein when the discharge device is connected to the image inspection device at the downstream side without another device in between and when the single-sided printing is performed for outputting the image data onto the first side of the recording medium and the recording medium is to be discharged with the first side facing up, the first conveying unit reverses the recording medium and then conveys the reversed recording medium, the reading unit further includes a second reader configured to read, from another direction opposite to the one direction, an image formed on the recording medium that is being conveyed, and when the discharge device is connected to the image inspection device at the downstream side without another device in between and when the single-sided printing is performed for outputting the image data onto the first side of the recording medium and the recording medium is to be discharged with the first side facing up, the second reader reads an image formed on the first side of the recording medium.

7. The image forming system according to claim 6, wherein when the discharge device is connected to the image inspection device at the downstream side without another device in between and when duplex printing is performed for outputting the image data not only onto the first side of the recording medium but also onto a second side that is the reverse side of the first side and the recording medium is to be discharged with the first side facing down, the first conveying unit reverses the recording medium and then conveys the reversed recording medium, when the discharge device is connected to the image inspection device at the downstream side without another device in between and when the duplex printing is performed and the recording medium is to be discharged with the first side facing down, the first reader reads an image formed on the first side of the recording medium, and when the discharge device is connected to the image inspection device at the downstream side without another device in between and when the duplex printing is performed and the recording medium is to be discharged with the first side facing down, the second reader reads an image formed on the second side of the recording medium.

8. The image forming system according to claim 7, wherein when the discharge device is connected to the image inspection device at the downstream side without another device in between and when the duplex printing is performed and the recording medium is to be discharged with the first side facing up, the first reader reads an image formed on the second side of the recording medium, and when the discharge device is connected to the image inspection device at the downstream side without another device in between and when the duplex printing is performed and the recording medium is to be discharged with the first side facing up, the second reader reads an image formed on the first side of the recording medium.

9. The image forming system according to claim 1, wherein the longer conveying path includes a cooling conveying path in which the recording medium is cooled while being conveyed, and when the discharge device is connected to the image inspection device at the downstream side without another device in between, the second conveying unit cools the recording medium by using the cooling conveying path and then conveys the cooled recording medium to the discharge device.

10. The image forming system according to claim 9, wherein, when the discharge device is connected to the image inspection device at the downstream side without another device in between, the time taken by the second conveying unit to convey the recording medium by using the cooling conveying path is longer than the time taken by the defect determining unit to determine whether the read image has a defect.

* * * * *